US010754294B2

(12) United States Patent
Nakai et al.

(10) Patent No.: US 10,754,294 B2
(45) Date of Patent: Aug. 25, 2020

(54) IMAGE FORMING APPARATUS TO REDUCE DETERIORATION OF TRANSFERABILITY

(71) Applicant: CANON KABUSHIKI KAISHA, Tokyo (JP)

(72) Inventors: Tomoaki Nakai, Numazu (JP); Shizuma Nishimura, Suntou-gun (JP); Masaki Shimomura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/513,288

(22) Filed: Jul. 16, 2019

(65) Prior Publication Data

US 2020/0041955 A1 Feb. 6, 2020

(30) Foreign Application Priority Data

Jul. 31, 2018 (JP) ..... 2018-143285
Jul. 31, 2018 (JP) ..... 2018-143286

(51) Int. Cl.
*G03G 21/20* (2006.01)
*G03G 15/00* (2006.01)
*G03G 15/16* (2006.01)

(52) U.S. Cl.
CPC ..... *G03G 21/203* (2013.01); *G03G 15/1665* (2013.01); *G03G 15/5054* (2013.01)

(58) Field of Classification Search
CPC ..... G03G 21/203; G03G 15/1665; G03G 15/5054; G03G 21/20; G03G 15/5008; G03G 15/1675
See application file for complete search history.

(56) References Cited

U.S. PATENT DOCUMENTS

2004/0126125 A1* 7/2004 Yoda ..... G03G 15/1625 399/45
2017/0277056 A1* 9/2017 Nakahara ..... G03G 15/0121

FOREIGN PATENT DOCUMENTS

| | | | |
|---|---|---|---|
| JP | 2001-194932 | A | 7/2001 |
| JP | 2006-171245 | A | 6/2006 |
| JP | 2006-337815 | A | 12/2006 |
| JP | 2010-217707 | A | 9/2010 |
| JP | 2017-173465 | A | 9/2017 |
| JP | 2018-072385 | A | 5/2018 |

* cited by examiner

*Primary Examiner* — Sandra Brase
(74) *Attorney, Agent, or Firm* — Canon U.S.A., Inc. IP Division

(57) ABSTRACT

A controller is configured to execute a larger gamut technology mode in which the controller performs image formation by controlling a ratio of a rotation speed of a development roller to a rotation speed of a photosensitive drum such that the ratio becomes a second speed ratio higher than a first speed ratio in a normal mode. The controller is configured to, when the controller executes the larger gamut technology mode, control transfer voltage based on a humidity around an image forming apparatus.

22 Claims, 10 Drawing Sheets

IMAGE FORMING APPARATUS TO REDUCE DETERIORATION OF TRANSFERABILITY

BACKGROUND

Field of the Disclosure

The present disclosure generally relates to image forming and, more particularly, to an image forming apparatus, such as a copying machine, a printer, and a facsimile, using electrophotography or electrostatic recording.

Description of the Related Art

The configurations of tandem image forming apparatuses are known as electrophotographic-type image forming apparatuses. In tandem-type image forming apparatuses, a plurality of image forming parts is disposed in the moving direction of a belt such as a conveying belt or an intermediate transfer belt. The image forming parts for colors each include a drum-shaped photosensitive member (hereinafter, referred to as photosensitive drum) that serves as an image bearing member. In such image forming apparatuses, through a charging step, an exposing step, a developing step, a transferring step, and a fixing step, an image is formed on a transfer material, such as paper and an overhead projector (OHP) sheet.

In the developing step, a toner image is developed on a photosensitive drum with toner carried on a development roller by application of voltage to the development roller. The development roller serves as a developing member provided in a developing unit. In the transferring step, a toner image carried on the photosensitive drum is electrostatically transferred onto a transfer material that is conveyed by a conveying belt, or an intermediate transfer belt by application of voltage (hereinafter, referred to as transfer voltage) to a transfer member facing the photosensitive drum.

Japanese Patent Laid-Open No. 2017-173465 describes the configuration of an image forming apparatus that is able to execute a mode of expanding the color reproduction range of an image to be formed on a transfer material (larger gamut technology mode). In the larger gamut technology mode of Japanese Patent Laid-Open No. 2017-173465, the amount of toner that is carried on a photosensitive drum per unit area is increased by setting the rotation speed of a development roller at a higher speed than the rotation speed of the photosensitive drum. Thus, the color reproduction range is expanded.

In the larger gamut technology mode described in Japanese Patent Laid-Open No. 2017-173465, the amount of toner that is carried on the photosensitive drum per unit area is greater than the amount of toner that is carried on the photosensitive drum per unit area in a normal mode in which the color reproduction range is not expanded. That is, when the transfer voltage in the larger gamut technology mode is set to the same value as the transfer voltage in the normal mode, transferability can be lower than desired transferability.

In this way, the transfer voltage at the time of execution of the larger gamut technology mode needs to be appropriately set according to an increased amount of toner. However, the amount of toner that is carried on the photosensitive drum per unit area in the larger gamut technology mode varies depending on the humidity or other conditions of a surrounding environment in which the image forming apparatus is used.

SUMMARY

The present disclosure reduces the deterioration of transferability regardless of a surrounding environment when a mode of increasing the amount of toner that is carried on a photosensitive drum per unit area is executed.

An image forming apparatus according to one or more aspects of the present disclosure can achieve reduction of the deterioration of transferability. In summary, according to one or more aspects of the present disclosure, an image forming apparatus includes an image bearing member configured to bear a toner image, a developing unit including a developing member disposed to face the image bearing member, the developing unit being configured to develop an electrostatic latent image, formed on the image bearing member, with toner, a movable belt configured to come into contact with the image bearing member, a transfer member provided at a position corresponding to the image bearing member with the belt interposed between the transfer member and the image bearing member, the transfer member being configured to transfer a toner image from the image bearing member to the belt, a transfer power supply configured to apply voltage to the transfer member; and a control unit configured to execute a first mode and a second mode, the first mode being a mode in which the control unit performs image formation by controlling a speed ratio of a rotation speed of the developing member to a rotation speed of the image bearing member such that the speed ratio becomes a first speed ratio, the second mode being a mode in which the control unit performs image formation by controlling the speed ratio of the rotation speed of the developing member to the rotation speed of the image bearing member such that the speed ratio becomes a second speed ratio higher than the first speed ratio. The control unit is configured to, in the second mode, control voltage that is applied from the transfer power supply to the transfer member such that a value of current flowing from the transfer member toward the image bearing member when a surrounding environment of the image forming apparatus is a first environment is greater than a value of current flowing from the transfer member toward the image bearing member when the surrounding environment is a second environment that is lower in humidity than the first environment.

Further features of the present disclosure will become apparent from the following description of exemplary embodiments with reference to the attached drawings.

DESCRIPTION OF THE EMBODIMENTS

Hereinafter, various exemplary embodiments, features, and aspects of the disclosure will be described with reference to the accompanying drawings. The dimensions, materials, and shapes of components that will be described in the following embodiments, the relative arrangement of the components, and the like, may be changed as needed depending on the configuration of an apparatus to which an embodiment of the present disclosure is applied or various conditions. Unless otherwise specified, those are not intended to limit the scope of the disclosure.

First Embodiment

Configuration of Image Forming Apparatus

Figure 1:
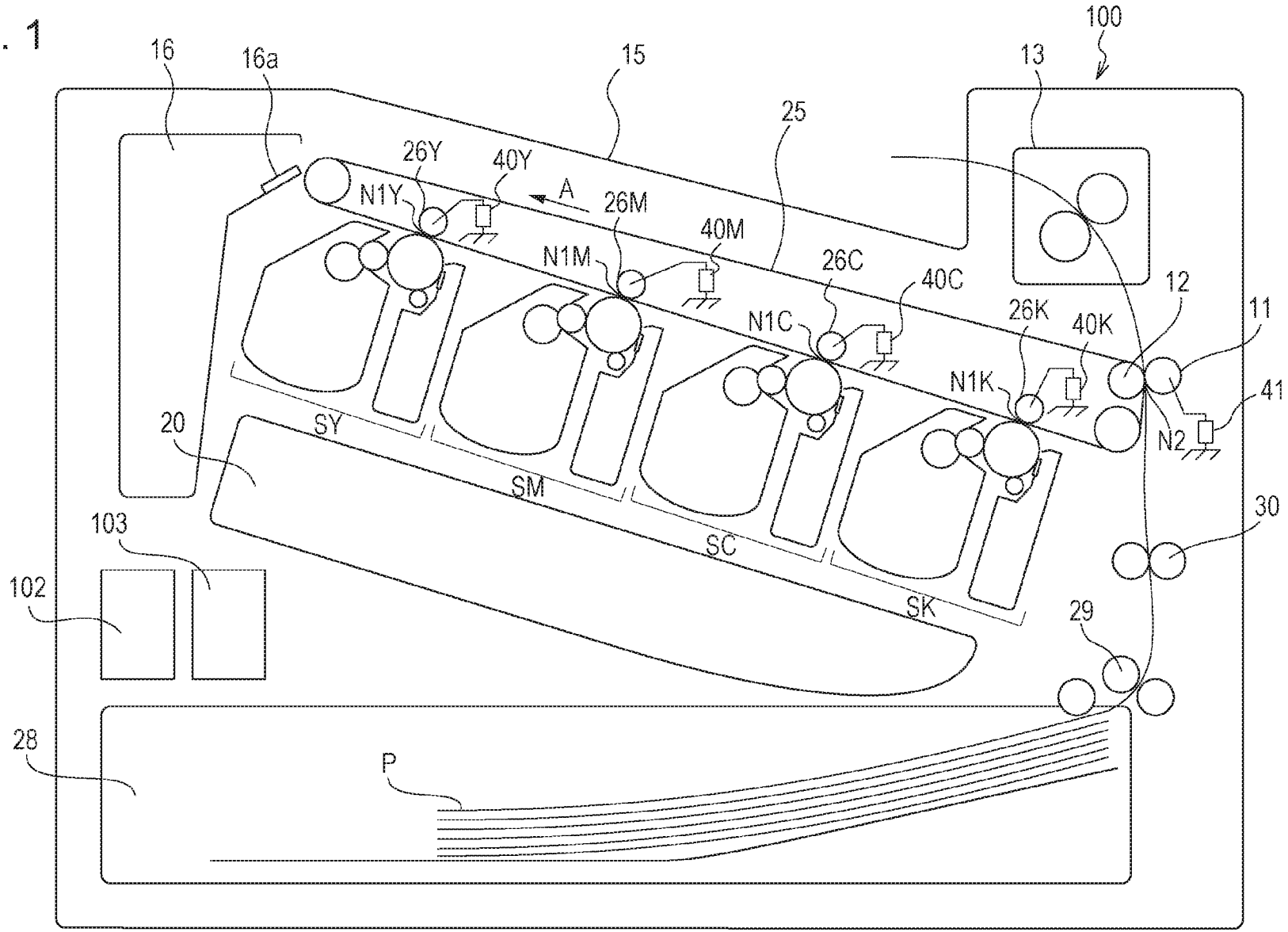
FIG. 1 is a schematic cross-sectional view that illustrates the configuration of an image forming apparatus.
Figure 2:
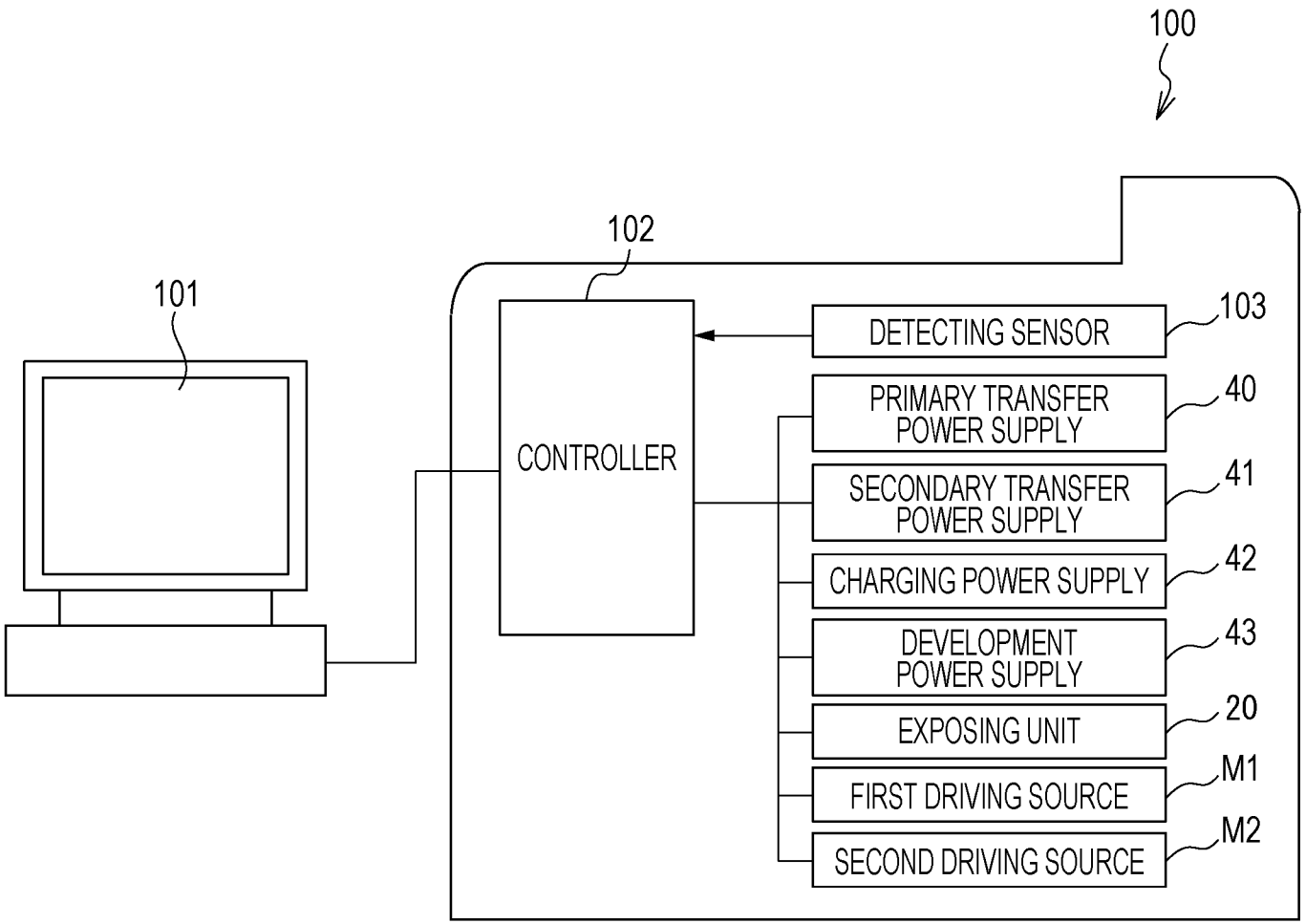
FIG. 2 is a block diagram of a control part of the image forming apparatus.

FIG. 1 is a schematic configuration diagram of an image forming apparatus 100 of a first embodiment. FIG. 2 is a block diagram of a control part of the image forming apparatus 100 of the first embodiment. As shown in FIG. 2, the image forming apparatus 100 is connected to a host computer 101. An operation start instruction and an image signal, generated by the host computer 101, are transmitted to a controller 102 that serves as a control unit. The controller 102, which may include one or more processors, one or more memories, circuitry, or a combination thereof, may control various units upon receiving the operation start instruction and the image signal. Thus, image formation is performed in the image forming apparatus 100.

As shown in FIG. 1, the image forming apparatus 100 of the first embodiment is an intermediate transfer-type color-image forming apparatus that uses electrophotography, and includes first, second, third, and fourth image forming parts SY, SM, SC, SK as a plurality of image forming units. The first, second, third, and fourth image forming parts SY, SM, SC, SK are respectively configured to form images of colors of yellow (Y), magenta (M), cyan (C), and black (Bk). These four image forming parts SY, SM, SC, SK are disposed in line at regular spacings. In the first embodiment, the image forming parts SY, SM, SC, SK are disposed below an intermediate transfer belt 25 in the direction of gravitational force. In the first embodiment, the configurations of the first to fourth image forming parts SY, SM, SC, SK are substantially the same except that colors of toners to be used are different. Therefore, unless otherwise specifically distinguished from one another, suffixes Y, M, C, K assigned to reference signs to indicate which color the elements are provided for are omitted, and the description will be made generally.

Figure 3:
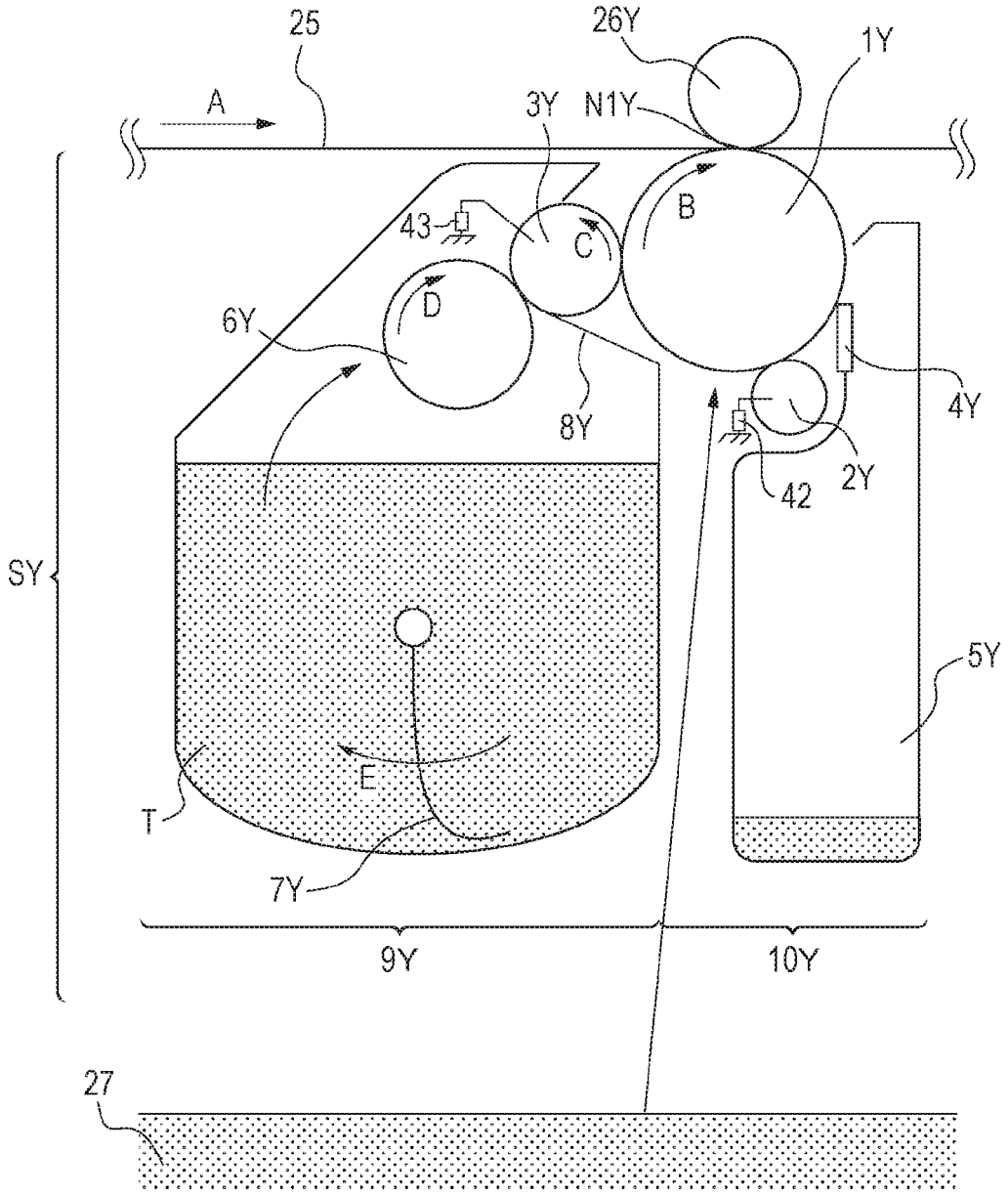
FIG. 3 is a schematic diagram that illustrates the configuration of an image forming part.

FIG. 3 is a schematic diagram that illustrates the configuration of the image forming part S of the first embodiment. As shown in FIG. 3, a drum-shaped electrophotographic photoreceptor (hereinafter, referred to as photosensitive drum) 1 that serves as an image bearing member on which a toner image is formed is provided in the image forming part S. The photosensitive drum 1 is rotatable in the direction of the arrow B in the drawing upon receiving driving force from a first driving source M1 (shown in FIG. 2). A charging roller 2, a developing unit 9, and a cleaning unit 10 are placed around the photosensitive drum 1. The charging roller 2 serves as a charging member to charge the photosensitive drum 1. An exposed portion is provided downstream of the charging roller 2 and upstream of the developing unit 9 in the rotation direction of the photosensitive drum 1. Laser light from an exposing unit 20 (laser scanner) is irradiated to the exposed portion.

The developing unit 9 includes a development roller 3 as a developing member, toner T as a developer, a supply roller 6 that supplies the toner T to the development roller 3, an agitating member 7 that rotates in the direction of the arrow E in the drawing, and a development blade 8 as a developer inhibiting unit. The development roller 3 is rotatable in the direction of the arrow C in the drawing upon receiving driving force from a second driving source M2 (shown in FIG. 2). The cleaning unit 10 includes a cleaning blade 4 and a waste toner container 5. The cleaning blade 4 serves as a cleaning member that comes into contact with the photosensitive drum 1. The waste toner container 5 contains toner collected by the cleaning blade 4.

Next, the overall configuration of the image forming apparatus 100 will be described. As shown in FIG. 1, the intermediate transfer belt 25 is disposed so as to face the photosensitive drum 1 of the image forming part S. The intermediate transfer belt 25 is an endless belt-shaped intermediate transfer member. The intermediate transfer belt 25 is laid across a plurality of support members in a tensioned state, and is movable in the direction of the arrow A in the drawing by a drive roller 12.

A primary transfer roller 26 is disposed at a position that faces the photosensitive drum 1 with the intermediate transfer belt 25 interposed between the primary transfer roller 26 and the photosensitive drum 1. The primary transfer roller 26 serves as a primary transfer member (transfer member). The primary transfer roller 26 is urged under a predetermined pressure toward the photosensitive drum 1 via the intermediate transfer belt 25, and forms a primary transfer portion (primary transfer nip) N1 at which the intermediate transfer belt 25 and the photosensitive drum 1 contact with each other. A primary transfer power supply 40 is connected to the primary transfer roller 26. The primary transfer power supply 40 can apply positive-polarity voltage or negative-polarity voltage to the primary transfer roller 26.

A secondary transfer roller 11 as a secondary transfer member is disposed at a position that faces the drive roller 12 on the outer peripheral surface of the intermediate transfer belt 25. The secondary transfer roller 11 is urged under a predetermined pressure toward the drive roller 12 with the intermediate transfer belt 25 interposed between the secondary transfer roller 11 and the drive roller 12, and forms a secondary transfer portion (secondary transfer nip) N2 at which the intermediate transfer belt 25 and the secondary transfer roller 11 contact with each other. A secondary transfer power supply 41 is connected to the secondary transfer roller 11. The secondary transfer power supply 41 can apply positive-polarity voltage or negative-polarity voltage to the secondary transfer roller 11.

The cleaning unit 16 is provided upstream of the photosensitive drums 1 and downstream of the secondary transfer portion N2 in the moving direction of the intermediate transfer belt 25. The cleaning unit 16 collects toner remaining on the intermediate transfer belt 25 (hereinafter, referred to as residual toner) after secondary transfer. The cleaning unit 16 includes a cleaning blade 16*a* that comes into contact with the intermediate transfer belt 25.

A sheet feeding cassette 28, a sheet feeding unit 29, and a conveyor roller 30 are provided upstream of the secondary transfer portion N2 in the conveying direction of a transfer material P to which an image is to be transferred. The sheet feeding cassette 28 accommodates a stack of the transfer material P. The sheet feeding unit 29 feeds the transfer material P accommodated in the sheet feeding cassette 28. The conveyor roller 30 conveys the fed transfer material P to the secondary transfer portion N2. A fixing unit 13 and an output tray 15 are provided downstream of the secondary transfer portion N2 in the conveying direction of the transfer material P. The fixing unit 13 includes a heat source. The output tray 15 stacks the transfer material P on which a toner image has been fixed by the fixing unit 13 and that has been output from the image forming apparatus 100.

Image Forming Operation

As shown in FIG. 3, as the image forming operation is started, the photosensitive drum 1, the intermediate transfer belt 25, the development roller 3, and the supply roller 6 respectively begin to rotate in the directions of the arrows A to D in the drawing at predetermined rotation speeds. The surface of the rotating photosensitive drum 1 is substantially uniformly electrically charged with a predetermined polarity (negative polarity in the first embodiment) by the charging roller 2. At this time, a predetermined charging voltage is applied from a charging power supply 42 to the charging roller 2. After that, the photosensitive drum 1 is subjected to exposure by the exposing unit 20 according to image information associated with each image forming part, with the result that an electrostatic latent image based on the image information is formed on the surface of the photosensitive drum 1.

The development roller 3 carries toner supplied by the supply roller 6 and charged with a normal charge polarity (negative polarity in the first embodiment) for toner by the development blade 8, and is applied with a predetermined developing voltage from a development power supply 43. Thus, the latent image formed on the photosensitive drum 1 is visualized by the negative-polarity toner at a portion (developing portion) at which the photosensitive drum 1 and the development roller 3 face, and a toner image is formed on the photosensitive drum 1.

Subsequently, the toner image formed on the photosensitive drum 1 is transferred (primarily transferred) at the primary transfer portion N1 to the intermediate transfer belt 25 being driven for rotation, by current flowing from the primary transfer roller 26 to the photosensitive drum 1 (hereinafter, referred to as primary transfer current). At this time, a voltage of a polarity (positive polarity in the first embodiment) reverse to the normal charge polarity for toner is applied from the primary transfer power supply 40 to the primary transfer roller 26. That is, in the configuration of the first embodiment, with constant current control for controlling the output of the primary transfer power supply 40 such that a predetermined primary transfer current flows from the primary transfer roller 26 to the photosensitive drum 1, a toner image is transferred from the photosensitive drum 1 to the intermediate transfer belt 25.

During formation of a full-color image, electrostatic latent images are formed on the photosensitive drums 1 of the corresponding image forming parts S and are developed, with the result that toner images of the respective colors are formed. Then, the toner images of the respective colors, formed on the photosensitive drums 1 of the corresponding image forming parts S, are sequentially transferred to the intermediate transfer belt 25 at the primary transfer portions N1Y, N1M, N1C, N1K so as to be put on top of each other, with the result that a four-color toner image is formed on the intermediate transfer belt 25.

The transfer material P stacked in the sheet feeding cassette 28 that serves as an accommodation part is fed to the conveyor roller 30 by the sheet feeding unit 29, and is conveyed to the secondary transfer portion N2 by the conveyor roller 30. Then, the four-color multi-toner image carried on the intermediate transfer belt 25 is transferred (secondarily transferred) at the secondary transfer portion N2 to the transfer material P being conveyed, by current flowing from the secondary transfer roller 11 to the intermediate transfer belt 25 (hereinafter, referred to as secondary transfer current). At this time, a secondary transfer voltage of a polarity (positive polarity in the first embodiment) reverse to the normal charge polarity for toner is applied from the secondary transfer power supply 41 to the secondary transfer roller 11. That is, in the configuration of the first embodiment, with constant current control for controlling the output of the secondary transfer power supply 41 such that a predetermined secondary transfer current flows from the secondary transfer roller 11 to the intermediate transfer belt 25, the toner image is secondarily transferred from the intermediate transfer belt 25 to the transfer material P.

After that, the transfer material P to which the toner image has been transferred is conveyed to the fixing unit 13 and discharged to the outside of the main body of the image forming apparatus 100 after the toner image is fixed to the surface of the transfer material P, and then stacked on the output tray 15.

Toner remaining on the photosensitive drum 1 after primary transfer is removed by the cleaning blade 4 from the surface of the photosensitive drum 1. Also, residual toner remaining on the intermediate transfer belt 25 after passage of the secondary transfer portion N2 is removed by the cleaning blade 16*a* from the surface of the intermediate transfer belt 25.

Image Formation in Larger Gamut Technology Mode

The image forming apparatus of the first embodiment is able to execute, in addition to a normal mode (first mode) that is a normal image forming mode, a larger gamut technology mode (second mode) in which the color reproduction range of an image to be formed on a transfer material P is expanded. In the larger gamut technology mode, the ratio of the rotation speed of the development roller 3 to the rotation speed of the photosensitive drum 1 is set to higher than the ratio of the rotation speed of the development roller 3 to the rotation speed of the photosensitive drum 1 in the normal mode. Thus, the amount of toner that is carried on the photosensitive drum 1 per unit area is increased, with the result that the color reproduction range is expanded. When the larger gamut technology mode is executed, not only the speed ratio of the development roller 3 to the photosensitive drum 1 is changed as compared to the normal mode but also the settings of the surface potential of the photosensitive drum 1 are changed. Hereinafter, various settings in the normal mode and in the larger gamut technology mode will be described.

Various Settings in Normal Mode and in Larger Gamut Technology Mode

Figure 4:
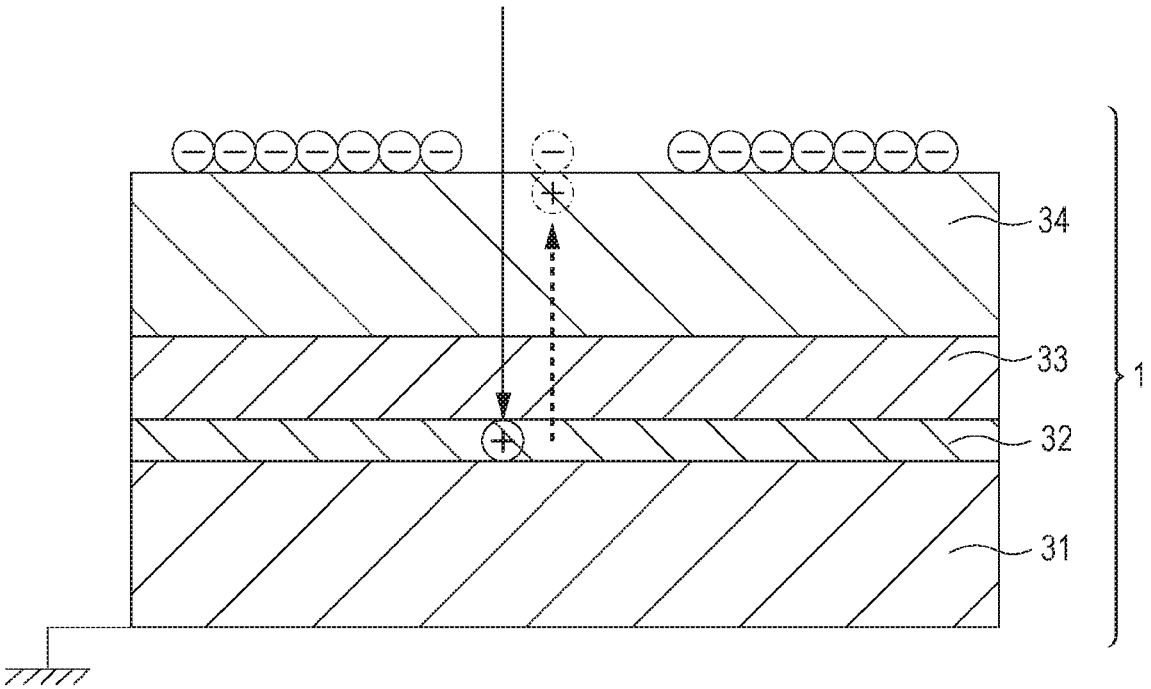
FIG. 4 is a schematic diagram that illustrates the layer configuration of a photosensitive drum.

FIG. 4 is a schematic diagram that illustrates the layer configuration of the photosensitive drum 1. As shown in FIG. 4, the photosensitive drum 1 has a substrate 31 made of an electrically conductive material, an undercoat layer 32 that improves the adhesiveness of an upper layer by inhibiting the interference of light, a charge generation layer 33 that generates carriers, and a charge transport layer 34 that transports generated carriers, in order from the lower layer.

The substrate 31 is grounded. When the photosensitive drum 1 is charged by the charging roller 2 applied with negative-polarity voltage, an electric field is formed from the inside of the photosensitive drum 1 toward the outside. When light is irradiated from the exposing unit 20 to the photosensitive drum 1, carriers are generated in the charge generation layer 33. The carriers generated in the charge generation layer 33 move from the inside of the photosensitive drum 1 to the outside under the above-described electric field, and are paired with electric charge on the surface of the photosensitive drum 1 charged by the charging roller 2. As a result, the surface potential of the photosensitive drum 1 changes.

Figure 5:
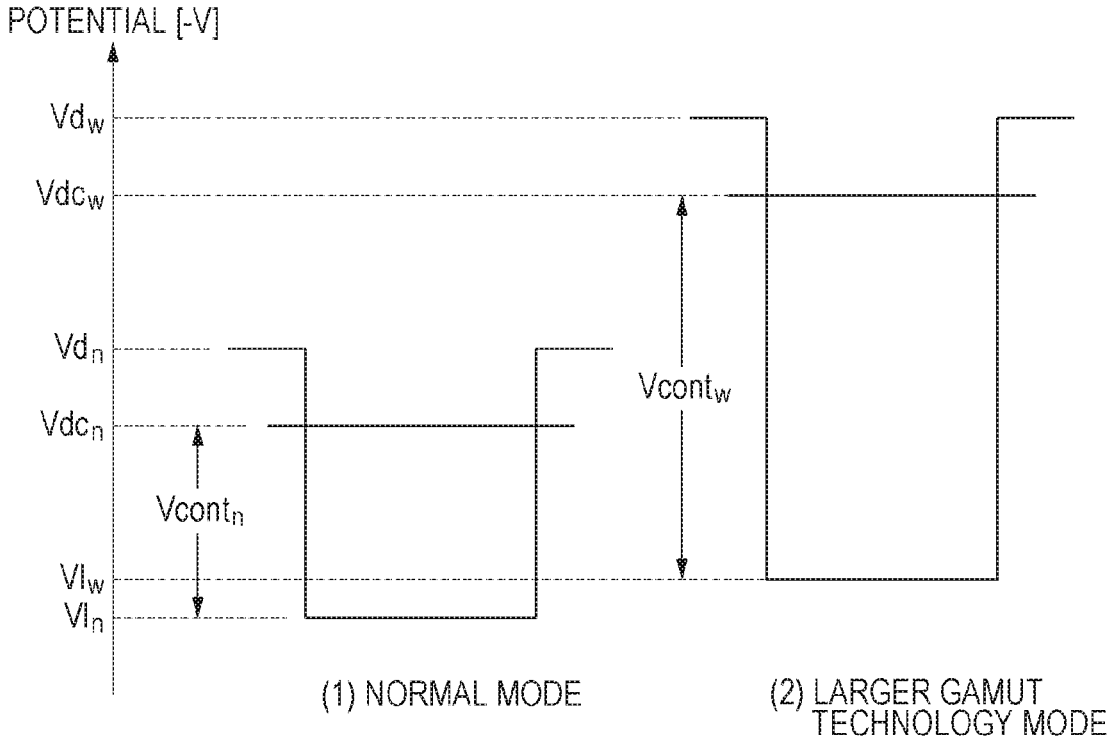
FIG. 5 is a schematic view that illustrates potentials that are formed on the photosensitive drum respectively in a normal mode and in a larger gamut technology mode.

FIG. 5 is a schematic view that illustrates potentials that are formed on the photosensitive drum 1 respectively in the normal mode and in the larger gamut technology mode. In FIG. 5, assuming that a potential formed on the photosensitive drum 1 as a result of being charged by the charging roller 2 is a background potential Vd, a potential formed on the photosensitive drum 1 as a result of exposure by the exposing unit 20 is a latent image potential V1, and a voltage that is applied to the development roller 3 is a development voltage Vdc. Also, in FIG. 5, description will be made with the suffix n being assigned to the potentials related to the normal mode and the suffix w being assigned to the potentials related to the larger gamut technology mode.

As shown in FIG. 5, the development voltage $Vdc_n$ in the normal mode is set between the latent image potential $Vl_n$ and the background potential $Vd_n$, and, similarly, the development voltage $Vdc_w$ in the larger gamut technology mode is set between the latent image potential $Vl_w$ and the background potential $Vd_w$. Therefore, in any of the normal mode and the larger gamut technology mode, negative-polarity toner carried on the development roller 3 electrostatically moves to the exposed portion exposed by the exposing unit 20, and does not electrostatically move to a non-exposed portion that is not exposed by the exposing unit 20.

When toner moves from the development roller 3 to the exposed portion of the photosensitive drum 1 and development proceeds, the potential in the exposed portion of the photosensitive drum 1 changes toward negative polarity by the toner charged with negative polarity, and the electric field that is formed between the development roller 3 and the photosensitive drum 1 weakens. That is, when the larger gamut technology mode is executed, even when the amount of toner per unit area on the photosensitive drum 1 is intended to be increased by increasing the speed ratio of the development roller 3 to the photosensitive drum 1, the amount of toner that can be carried on the photosensitive drum 1 saturates at a predetermined speed ratio.

To further expand the color reproduction range by further increasing the amount of toner that is carried on the photosensitive drum 1 per unit area, a potential difference $Vcont_w$ between the latent image potential $Vl_w$ and the development voltage $Vdc_w$ to be formed on the photosensitive drum 1 needs to be set to a sufficiently large potential difference. Even when the amount of exposure by the exposing unit 20 is further increased in a state where the potential charged by the charging roller 2 has sufficiently disappeared, carriers generated in the charge generation layer 33 do not move to the surface because of weakening of the electric field inside the photosensitive drum 1, and the potential of the exposed portion does not change. Therefore, to set a further higher potential difference $Vcont_w$, electric charge that is charged by the charging roller 2 needs to be controlled such that the value of the background potential $Vd_w$ increases.

In the first embodiment, to further expand the color reproduction range in the larger gamut technology mode, not only the speed ratio of the development roller 3 to the photosensitive drum 1 is increased as compared to that in the normal mode but also the potential difference $Vcont_w$ in the larger gamut technology mode is set to greater than the potential difference $Vcont_n$ in the normal mode. More specifically, in the normal mode of the first embodiment, the speed ratio (first speed ratio) of the rotation speed of the development roller 3 to the rotation speed of the photosensitive drum 1 is set to 140%, the background potential $Vd_n$ is set to −500 V, the development voltage $Vdc_n$ is set to −350 V, and the latent image potential $Vl_n$ is set to −100 V. In the larger gamut technology mode, the speed ratio (second speed ratio) of the rotation speed of the development roller 3 to the rotation speed of the photosensitive drum 1 is set to 280%, the background potential $Vd_w$ is set to −850 V, the development voltage $Vdc_w$ is set to −600 V, and the latent image potential $Vl_w$ is set to −120 V. In the first embodiment, when the larger gamut technology mode is executed, the speed ratio of the rotation speed of the development roller 3 to the rotation speed of the photosensitive drum 1 is set to 280% regardless of a surrounding environment.

Primary Transfer Control in Larger Gamut Technology Mode

As described above, in the larger gamut technology mode, the amount of toner that is carried on the photosensitive drum 1 per unit area is greater than the amount of toner that is carried on the photosensitive drum 1 per unit area in the normal mode. That is, a voltage (hereinafter, referred to as transfer voltage) that is applied from the primary transfer power supply 40 to the primary transfer roller 26 to transfer a toner image from the photosensitive drum 1 to the intermediate transfer belt 25 in the larger gamut technology mode needs to be appropriately set according to the increased amount of toner.

More specifically, when the primary transfer voltage is set to the same value as the primary transfer voltage in the normal mode, there is a possibility that toner carried on the photosensitive drum 1 cannot be sufficiently transferred to the intermediate transfer belt 25 and desired transferability is not obtained in the larger gamut technology mode. On the other hand, when the primary transfer voltage is set to an excessively high value, discharge may occur at the primary transfer portion N1 at which the intermediate transfer belt 25 contacts with the photosensitive drum 1, and the charge polarity of toner carried on the intermediate transfer belt 25 may be reversed. As a result, there is a possibility that a phenomenon (hereinafter, referred to as retransfer) that toner having a reversed charge polarity electrostatically moves from the intermediate transfer belt 25 to the photosensitive drum 1 occurs and desired transferability is not obtained.

Therefore, the primary transfer voltage in the larger gamut technology mode needs to be appropriately set according to the amount of toner carried on the photosensitive drum 1. However, the amount of toner that is carried on the photosensitive drum 1 comes under the influence of the speed ratio of the rotation speed of the development roller 3 to the rotation speed of the photosensitive drum 1 and the temperature and humidity of a surrounding environment in which the image forming apparatus 100 is used. In the first embodiment, since the speed ratio of the rotation speed of the development roller 3 to the rotation speed of the photosensitive drum 1 is set to a constant value regardless of a surrounding environment when the larger gamut technology mode is executed, the amount of toner that is carried on the photosensitive drum 1 comes under the influence of the temperature and humidity of the surrounding environment.

For this reason, in the configuration of the first embodiment, the temperature and the humidity are detected by a detecting sensor 103 as a detecting unit that detects a surrounding environment, and an optimal primary transfer voltage is set based on a weight absolute humidity obtained from the detected temperature and humidity. More specifically, in the configuration of the first embodiment, the value of primary transfer current is set in advance based on the value of weight absolute humidity, and an appropriate primary transfer voltage is applied from the primary transfer power supply 40 to the primary transfer roller 26 based on the value of primary transfer current.

Table 1 is a table that shows the value of primary transfer current based on the value of weight absolute humidity. In the first embodiment, the values of weight absolute humidity and primary transfer current are stored in a storage unit of the controller 102 in advance as a look-up table (LUT). As shown in Table 1, for example, when the weight absolute humidity is 3.0 (g/kg), the controller 102 controls the voltage that is applied from the primary transfer power supply 40 to the primary transfer roller 26 such that a primary transfer current of 20 μA flows from the primary transfer roller 26 toward the photosensitive drum 1.

TABLE 1

Set values of primary transfer current in larger gamut technology mode for First Embodiment

| Weight Absolute Humidity (g/kg) | Primary Transfer Current (μA) |
|---|---|
| 0 or higher and lower than 5 | 20 |
| 5 or higher and lower than 15 | 23 |
| 15 or higher | 26 |

Next, for a first comparative example and the first embodiment, the larger gamut technology mode was executed at some weight absolute humidities, and then transfer efficiency and retransfer were evaluated. In the first comparative example, in any environment, the voltage that was applied from the primary transfer power supply 40 to the primary transfer roller 26 was controlled such that the primary transfer current became 23 μA that was the optimal primary transfer current when the weight absolute humidity was higher than or equal to 5 (g/kg) and less than 15 (g/kg) in Table 1. The configuration of the first comparative example is the same as the first embodiment except that the primary transfer current is not changed based on the weight absolute humidity, so like reference signs denote portions common to the first embodiment, and the description thereof is omitted. High-brightness paper GF-0081 (grammage: 81.4 g/m$^2$) made by CANON KABUSHIKI KAISHA was used as the transfer material P at the time of evaluations, and then evaluations were carried out in a state where the image forming parts S were almost new.

Table 2 is a table that shows the evaluation results on the first embodiment and the first comparative example. Since the differences in transfer efficiency among the colors were small, the transfer efficiency in the image forming part SC was evaluated. Specifically, the evaluation results are shown in Table 2 where the result that the transfer efficiency in the image forming part SC is higher than or equal to 98% is "Good", the result that the transfer efficiency is higher than or equal to 95% and less than 98% is "Not so good", and the result that the transfer efficiency is less than 95% is "Not good". Retransfer was evaluated based on the weight ratio of magenta toner retransferred to the photosensitive drum 1C of the image forming part SC to magenta toner transferred from the photosensitive drum 1M to the intermediate transfer belt 25. Specifically, the result that magenta toner retransferred to the photosensitive drum 1C was lower than 2% of magenta toner transferred from the photosensitive drum 1M to the intermediate transfer belt 25 was "Good", the result that the retransferred magenta toner was higher than or equal to 2% and lower than 5% was "Not so good", and the result that the retransferred magenta toner was higher than or equal to 5% was "Not good".

TABLE 2

Evaluation results of transfer efficiency and retransfer on the first embodiment and the first comparative example

| | Weight Absolute Humidity (g/kg) | Transfer Efficiency | Retransfer |
|---|---|---|---|
| First Embodiment | 0 or higher and lower than 5 | Good | Good |
| | 5 or higher and lower than 15 | Good | Good |
| | 15 or higher | Good | Good |
| First Comparative Example | 0 or higher and lower than 5 | Good | Not good |
| | 5 or higher and lower than 15 | Good | Good |
| | 15 or higher | Not so good | Good |

As shown in Table 2, with the configuration of the first embodiment, when image formation was performed in the larger gamut technology mode, image formation was carried out at good transfer efficiency in any environment, and retransfer was also reduced. On the other hand, in the first comparative example, sufficient transfer efficiency was not obtained in the environment in which the weight absolute humidity was higher than or equal to 15 (g/kg), and retransfer occurred in the environment in which the weight absolute humidity was lower than 5 (g/kg).

The amount of toner that is carried from the development roller 3 onto the photosensitive drum 1 (hereinafter, simply referred to as toner coverage) varies with the amount of charge of toner per unit mass (hereinafter, referred to as triboelectricity). The toner coverage reduces as the triboelectricity increases; whereas the toner coverage increases as the triboelectricity decreases. The value of triboelectricity varies depending on a surrounding environment. The value of triboelectricity increases as the weight absolute humidity decreases, and decreases as the weight absolute humidity increases. That is, compared to the toner coverage when the weight absolute humidity is higher than or equal to 5 (g/kg) and lower than 15 (g/kg), the toner coverage increases as the weight absolute humidity increases, and decreases as the weight absolute humidity decreases.

Therefore, with the configuration of the first comparative example, the toner coverage in the environment in which the weight absolute humidity was higher than or equal to 15 (g/kg) was greater than the toner coverage in the environment in which the weight absolute humidity was higher than or equal to 5 (g/kg) and lower than 15 (g/kg), with the result that the primary transfer current was not enough and sufficient transfer efficiency was not obtained. Because the toner coverage in the environment in which the weight absolute humidity was lower than 5 (g/kg) was less than the toner coverage in the environment in which the weight absolute humidity was higher than or equal to 5 (g/kg) and lower than 15 (g/kg), the primary transfer current was excessive, and retransfer due to discharge occurred.

As described above, with the configuration of the first embodiment, the primary transfer voltage that is applied from the primary transfer power supply 40 to the primary transfer roller 26 at the time of transferring a toner image from the photosensitive drum 1 to the intermediate transfer belt 25 in the larger gamut technology mode is controlled based on a surrounding environment of the image forming apparatus 100. Thus, it is possible to reduce a decrease in transferability by reducing a decrease in transfer efficiency and retransfer regardless of a surrounding environment.

Second Embodiment

In the first embodiment, the configuration for setting the primary transfer voltage in the larger gamut technology mode based on a surrounding environment of the image forming apparatus 100 is described. In contrast to this, in a second embodiment, the configuration for setting the primary transfer voltage in the larger gamut technology mode based on a surrounding environment of the image forming apparatus 100 and a durability of the image forming part S will be described. The configuration of the second embodiment is the same as the configuration of the first embodiment except that the primary transfer voltage is set based on a surrounding environment of the image forming apparatus 100 and a durability of the image forming part S. Therefore, in the following description, like reference signs denote portions common to the first embodiment, and the description thereof is omitted.

Primary Transfer Control in Larger Gamut Technology Mode

As described in the first embodiment, the primary transfer voltage in the larger gamut technology mode needs to be appropriately set according to a toner coverage, and the toner coverage varies with triboelectricity. The triboelectricity of toner also varies depending on a durability of the image forming part S. More specifically, as compared to the early stage of service of the image forming part S, the triboelectricity of toner tends to decrease in the late stage of service. For this reason, in the second embodiment, an appropriate primary transfer voltage is set based on a weight absolute humidity obtained from a surrounding environment of the image forming apparatus 100, and a durability of the image forming part S. More specifically, in the configuration of the second embodiment, the value of primary transfer current is set in advance based on a weight absolute humidity and a durability of the image forming part S, and an appropriate primary transfer voltage is applied from the primary transfer power supply 40 to the primary transfer roller 26 based on the value of primary transfer current.

In the second embodiment, the controller 102 integrates a driving duration of each image forming part S from the time when the image forming part S is new, and calculates the durability of each image forming part S where an integrated driving duration determined as a service life is 100%. That is, the durability of each image forming part S is 0% when the image forming part S is new, increases as image formation is performed, and reaches 100% at the end of the service life. In the second embodiment, the integrated driving duration of the image forming part S is calculated by the controller 102 each time image formation is complete, and is written into a non-volatile memory (not shown) provided in the image forming part S one by one.

Table 3 is a table that shows the value of primary transfer current based on a durability of the image forming part S and a weight absolute humidity. In the second embodiment, the value of primary transfer current based on a durability of the image forming part S and a weight absolute humidity is stored in the storage unit of the controller 102 in advance as a look-up table (LUT). As shown in Table 3, for example, when the durability of the image forming unit S is 40% and the weight absolute humidity is 3.0 (g/kg), the controller 102 controls the primary transfer voltage that is applied from the primary transfer power supply 40 to the primary transfer roller 26 such that the primary transfer current becomes 21 μA.

TABLE 3

Set values of primary transfer current in larger gamut technology mode for Second Embodiment

| | | Durability of Image Forming Part S | | |
|---|---|---|---|---|
| | | 0% or higher and lower than 25% | 25% or higher and lower than 50% | 50% or higher |
| Weight Absolute Humidity (g/kg) | 0 or higher and lower than 5 | 20 μA | 21 μA | 22 μA |
| | 5 or higher and lower than 15 | 23 μA | 24 μA | 25 μA |
| | 15 or higher | 26 μA | 27 μA | 28 μA |

Next, for a second comparative example and the second embodiment, the larger gamut technology mode was executed at some weight absolute humidities for some durabilities of the image forming part S, and then transfer efficiency and retransfer were evaluated. In the second comparative example, in any durability and any environment, the voltage that was applied from the primary transfer power supply 40 to the primary transfer roller 26 was controlled such that the primary transfer current became 24 μA. The set primary transfer current 24 μA is an optimal value of primary transfer current when the durability of the image forming part S is 40% and the weight absolute humidity is higher than or equal to 5 (g/kg) and lower than 15 (g/kg) in Table 3. In the following description, like reference signs denote portions common to the second embodiment in the configuration of the second comparative example, and the description thereof is omitted. The transfer material P and evaluation criteria at the time of evaluations are similar to those of the first embodiment, so the description is omitted.

Table 4 is a table that shows the evaluation results of transfer efficiency on the second embodiment and the second comparative example. Table 5 is a table that shows the evaluation results of retransfer on the second embodiment and the second comparative example.

TABLE 4

Evaluation results of transfer efficiency on the second embodiment and the second comparative example

| | | | Durability of Image Forming Part S | | |
|---|---|---|---|---|---|
| | | | 0% or higher and lower than 25% | 25% or higher and lower than 50% | 50% or higher |
| Second Embodiment | Weight Absolute Humidity (g/kg) | 0 or higher and lower than 5 | Good | Good | Good |
| | | 5 or higher and lower than 15 | Good | Good | Good |
| | | 15 or higher | Good | Good | Good |

TABLE 4-continued

| Evaluation results of transfer efficiency on the second embodiment and the second comparative example | | | | | |
|---|---|---|---|---|---|
| | | | Durability of Image Forming Part S | | |
| | | | 0% or higher and lower than 25% | 25% or higher and lower than 50% | 50% or higher |
| Second Comparative Example | Weight Absolute Humidity (g/kg) | 0 or higher and lower than 5 | Good | Good | Good |
| | | 5 or higher and lower than 15 | Good | Good | Not so good |
| | | 15 or higher | Not so good | Not so good | Not good |

As shown in Table 4, with the configuration of the second embodiment, when image formation was performed in the larger gamut technology mode, image formation was carried out at good transfer efficiency in any durability and any environment. On the other hand, in the second comparative example, sufficient transfer efficiency was not obtained in the environment in which the weight absolute humidity was higher than or equal to 15 (g/kg), and the tendency that the transfer efficiency further decreased with an increase in the durability of the image forming part S was observed. This can be understood that triboelectricity further decreased with an increase in the durability of the image forming part S, the primary transfer current became more insufficient as a result of a further increase in the toner coverage, and sufficient transfer efficiency was not obtained.

TABLE 5

| Evaluation results of retransfer on the second embodiment and the second comparative example | | | | | |
|---|---|---|---|---|---|
| | | | Durability of Image Forming Part S | | |
| | | | 0% or higher and lower than 25% | 25% or higher and lower than 50% | 50% or higher |
| Second Embodiment | Weight Absolute Humidity (g/kg) | 0 or higher and lower than 5 | Good | Good | Good |
| | | 5 or higher and lower than 15 | Good | Good | Good |
| | | 15 or higher | Good | Good | Good |
| Second Comparative Example | Weight Absolute Humidity (g/kg) | 0 or higher and lower than 5 | Not good | Not so good | Not so good |
| | | 5 or higher and lower than 15 | Good | Good | Good |
| | | 15 or higher | Good | Good | Good |

As shown in Table 5, with the configuration of the second embodiment, when image formation was performed in the larger gamut technology mode, retransfer was reduced in any durability and any environment. On the other hand, in the second comparative example, it was difficult to reduce retransfer in the environment in which the weight absolute humidity was lower than 5 (g/kg). Occurrence of retransfer in the second comparative example is understood that the primary transfer current becomes excessive as a result of a reduction in toner coverage in the environment in which the weight absolute humidity is lower than 5 (g/kg). Since the triboelectricity decreased with an increase in the durability of the image forming part S, the toner coverage somewhat increased as compared to when the durability was low; however, retransfer was not reduced as much as in the case of the configuration of the second embodiment.

As described above, with the configuration of the second embodiment, the primary transfer voltage that is applied from the primary transfer power supply 40 to the primary transfer roller 26 in the larger gamut technology mode is controlled based on a durability of the image forming part S and a surrounding environment of the image forming apparatus 100. Thus, similar advantageous effects to those of the first embodiment are also obtained in the second embodiment.

In the second embodiment, the durability of each image forming part S was obtained by integrating a driving duration of the image forming part S from the time when the image forming part S is new; however, the durability of the image forming part S is not limited thereto. For example, the durability of the image forming part S may be obtained from an integrated value of the number of rotations of the development roller 3 or the amount of toner contained in the developing unit 9. Besides these configurations, the durability of the image forming part S may be obtained from the film thickness of the photosensitive drum 1, an integrated rotating duration of the photosensitive drum 1, a surface moving amount of the photosensitive drum 1, or another parameter.

Setting of Primary Transfer Current in Larger Gamut Technology Mode

In the second embodiment, the ratio of the primary transfer current in the larger gamut technology mode to the primary transfer current in the normal mode is set to lower than the ratio of the toner coverage in the larger gamut technology mode to the toner coverage in the normal mode. Hereinafter, this setting will be described in detail.

With the configuration of the second embodiment, in the image forming part SC of which the weight absolute humidity was 8.9 (g/kg) and the durability was 40%, the toner coverage during execution of the normal mode was 0.45 ($mg/cm^2$), and the toner coverage during execution of the larger gamut technology mode was 0.68 ($mg/cm^2$). That is, the ratio of the toner coverage of the larger gamut technology mode to the toner coverage of the normal mode in the image forming part SC of which the weight absolute humidity is 8.9 (g/kg) and the durability is 40% is 1.51 (0.68/0.45).

On the other hand, with the configuration of the second embodiment, in the image forming part SC of which the weight absolute humidity was 8.9 (g/kg) and the durability was 40%, the primary transfer current during execution of the normal mode was set to 18 μA, and the primary transfer current during execution of the larger gamut technology mode was set to 24 μA. That is, the ratio of the primary transfer current of the larger gamut technology mode to the primary transfer current of the normal mode in the image forming part SC of which the weight absolute humidity is 8.9 (g/kg) and the durability is 40% is 1.33 (24/18), and is lower than 1.51 that is the ratio of the toner coverage.

Subsequently, transfer efficiency and retransfer were evaluated on setting of the primary transfer current for the configurations of the second embodiment, third comparative example, and the fourth comparative example. Table 6 is a table that shows the evaluation results on the second embodiment, a third comparative example, and a fourth comparative example. Evaluations that will be described below were carried out by using the image forming part SC of which the durability was 40% in the environment in which the weight absolute humidity was 8.9 (g/kg). High-brightness paper GF-0081 (grammage: 81.4 $g/m^2$) made by CANON KABUSHIKI KAISHA was used as the transfer material P at the time of evaluations. The configurations of the third comparative example and the fourth comparative example are the same as that of the second embodiment except that the set values of primary transfer current are different, so like reference signs denote portions common to the second embodiment, and the description thereof is omitted. Evaluation methods for transfer efficiency and retransfer are similar to those of the first embodiment or the second embodiment, so the description is omitted.

In the configuration of the third comparative example, the primary transfer current in the larger gamut technology mode was set to 27.2 μA such that the ratio of the primary transfer current of the larger gamut technology mode to the primary transfer current of the normal mode became 1.51 that was the same as the ratio of the toner coverage of the larger gamut technology mode to the toner coverage of the normal mode. In the configuration of the fourth comparative example, the primary transfer current in the larger gamut technology mode was set to 30.0 μA such that the ratio of the primary transfer current of the larger gamut technology mode to the primary transfer current of the normal mode became higher than the ratio of the toner coverage of the larger gamut technology mode to the toner coverage of the normal mode.

TABLE 6

Evaluation results of transfer efficiency and retransfer on the second embodiment, the third comparative example, and the fourth comparative example

| | Transfer Efficiency | Retransfer |
|---|---|---|
| Second Embodiment | Good | Good |
| Third Comparative Example | Good | Not so good |
| Fourth Comparative Example | Not so good | Not good |

As shown in Table 6, in the second embodiment, when image formation was performed in the larger gamut technology mode, image formation was carried out at good transfer efficiency in any environment, and retransfer was also reduced. On the other hand, retransfer occurred in the third comparative example and the fourth comparative example, and sufficient transfer efficiency was not obtained in the fourth comparative example. The reasons for this will be described below with reference to FIG. 6.

Figure 6:
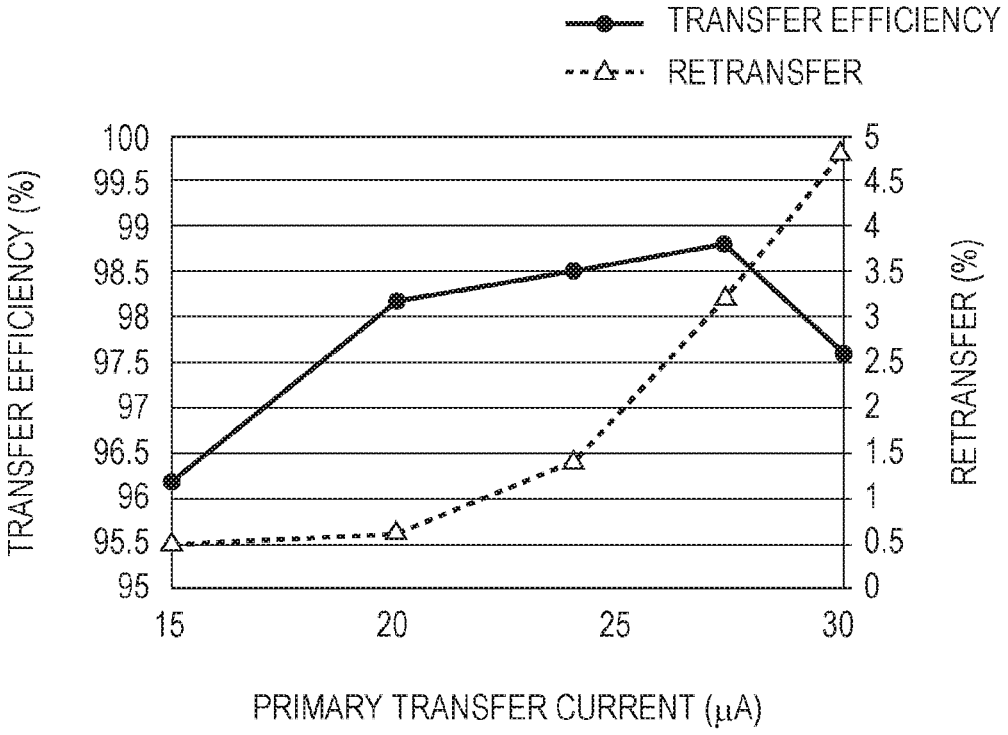
FIG. 6 is a graph that illustrates the relationship between transfer efficiency and retransfer, according to a value of primary transfer current.

FIG. 6 is a graph that illustrates the relationship between the value of primary transfer current and each of transfer efficiency and retransfer. As shown in FIG. 6, as the value of primary transfer current is increased, electric field intensity increases, and transfer efficiency improves. However, when the primary transfer current is excessively increased, the charge polarity of part of toner reverses because of discharge that occurs at the primary transfer portion N1. Then, toner whose charge polarity has been reversed is not transferred from the photosensitive drum 1 to the intermediate transfer belt 25 and remains on the photosensitive drum 1. Thus, transfer efficiency deteriorates. For retransfer, as the primary transfer current is increased, excessive current flows through the primary transfer portion N1, and discharge remarkably occurs. As a result, of toner primarily transferred to the intermediate transfer belt 25, toner whose charging polarity reverses increases, and the amount of toner to be retransferred increases.

As described above, with the configuration of the second embodiment, the ratio of the primary transfer current in the larger gamut technology mode to the primary transfer current in the normal mode is set to lower than the ratio of the toner coverage in the larger gamut technology mode to the toner coverage in the normal mode. Thus, transfer efficiency and retransfer are balanced, so a decrease in transferability can be reduced.

In the second embodiment, the configuration for setting the primary transfer current in the larger gamut technology mode based on a durability of the image forming part S and a surrounding environment and making the ratio of the primary transfer current to the normal mode lower than the ratio of the toner coverage to the normal mode is described. Instead, the configuration in which, in the larger gamut technology mode, the ratio of the primary transfer current to the normal mode is made lower than the ratio of the toner coverage to the normal mode may be applied to the configuration in which the primary transfer current is set based on a surrounding environment as in the case of the first embodiment. When the primary transfer current is set in this way, transfer efficiency and retransfer are balanced in the configuration of the first embodiment as in the case of the second embodiment, so a decrease in transferability can be reduced.

Third Embodiment

In the first embodiment and the second embodiment, the configuration in which, when the larger gamut technology mode is executed, the toner coverage is increased as compared to the normal mode in all the four image forming parts SY, SM, SC, SK is described. In contrast to this, in a third embodiment, the configuration in which, when the larger gamut technology mode is executed, the toner coverage is increased as compared to the normal mode in the image forming parts SY, SM, SC and the toner coverage is not increased as compared to the normal mode in the image forming part SK will be described. The configuration of the third embodiment is substantially the same as that of the second embodiment except that the toner coverage is not increased as compared to the normal mode in the image forming part SK. Therefore, in the following description, like reference signs denote portions common to the second embodiment, and the description thereof is omitted.

In the image forming part SK that contains black toner, an increased toner coverage may not significantly contribute to expansion of the color reproduction range since images that are formed by black toner are mainly characters. For this reason, in the third embodiment, when the larger gamut technology mode is executed, the ratio of the rotation speed of the development roller 3K to the rotation speed of the photosensitive drum 1K is set to the same value as the speed ratio of the normal mode and the toner coverage is not increased for the image forming part SK. Thus, consumption of toner in the image forming part SK is reduced.

As shown in FIG. 1, the image forming part SK in the third embodiment is disposed downstream of the image forming parts SY, SM, SC in the moving direction of the intermediate transfer belt 25. That is, when the larger gamut technology mode is executed, a toner image transferred to the intermediate transfer belt 25 in a state where the toner coverage is greater than that in the normal mode in the upstream-side image forming parts S reaches the primary transfer portion N1K even when the toner coverage is not increased in the image forming part SK. Then, when the primary transfer voltage that is the same as that in the normal mode is applied from the primary transfer power supply 40K to the primary transfer roller 26K, transfer efficiency may decrease at the time when a toner image carried on the photosensitive drum 1K is primarily transferred to the intermediate transfer belt 25.

For this reason, in the larger gamut technology mode of the third embodiment, although the toner coverage is not increased for the image forming part SK, an optimal primary transfer voltage that is applied to the primary transfer roller 26K is set based on a surrounding environment of the image forming apparatus 100 and a durability of the image forming part S. In the configuration of the third embodiment, a weight absolute humidity was used as in the case of the second embodiment for a surrounding environment of the image forming apparatus 100, and a durability of the image forming part S was calculated by using a similar method to that of the second embodiment.

Table 7 is a table that shows the value of primary transfer current based on a durability of the image forming part SK and a weight absolute humidity. In the third embodiment, the value of primary transfer current based on a durability of the image forming part S and a weight absolute humidity is stored in the storage unit of the controller 102 in advance as a look-up table (LUT). As shown in Table 7, for example, when the durability of the image forming unit SK is 40% and the weight absolute humidity is 3.0 (g/kg), the controller 102 controls the voltage that is applied from the primary transfer power supply 40K to the primary transfer roller 26 such that the primary transfer current becomes 19 μA.

TABLE 7

Set values of primary transfer current on image forming part SK in larger gamut technology mode for the third embodiment

| | | | Durability of Image Forming Part SK | | |
|---|---|---|---|---|---|
| | | | 0% or higher and lower than 25% | 25% or higher and lower than 50% | 50% or higher |
| Normal Mode | Weight Absolute Humidity (g/kg) | 0 or higher and lower than 5 | 15 μA | 16 μA | 17 μA |
| | | 5 or higher and lower than 15 | 17 μA | 18 μA | 19 μA |
| | | 15 or higher | 20 μA | 21 μA | 22 μA |
| Larger Gamut Technology Mode | Weight Absolute Humidity (g/kg) | 0 or higher and lower than 5 | 18 μA | 19 μA | 20 μA |
| | | 5 or higher and lower than 15 | 21 μA | 22 μA | 23 μA |
| | | 15 or higher | 24 μA | 25 μA | 26 μA |

As described above, in the configuration of the third embodiment, even when the toner coverage in the image forming part SK is not increased, the value of primary transfer current that is caused to flow from the primary transfer roller 26K to the photosensitive drum 1K is set to greater than that in the normal mode. Thus, even when the toner coverage in the image forming part SK is not increased at the time of execution of the larger gamut technology mode, good transferability can be ensured.

In the third embodiment, when the larger gamut technology mode was executed, the ratio of the rotation speed of the development roller 3K to the rotation speed of the photosensitive drum 1K was set to the same value as the speed ratio of the normal mode for the image forming part SK; however, the configuration is not limited thereto. For example, when control over the primary transfer voltage in the third embodiment is used in the configuration in which the toner coverage in the image forming part SK is not made the same as that of the normal mode but made less than the toner coverages in the image forming parts SY, SM, SC, similar advantageous effects are obtained. In this case, when the larger gamut technology mode is executed, the ratio of the rotation speed of the development roller 3K to the rotation speed of the photosensitive drum 1K is higher than the speed ratio in the normal mode, and is lower than the speed ratios in the image forming parts SY, SM, SC where the larger gamut technology mode is being executed.

In the first to third embodiments, the configuration of constant current control for, at the time when a toner image is primarily transferred to the intermediate transfer belt 25, controlling the output of the primary transfer power supply 40 based on a surrounding environment such that a predetermined current set in advance flows from the primary transfer roller 26 toward the photosensitive drum 1 is described. However, the configuration is not limited thereto. With a configuration in which a toner image is transferred from the photosensitive drum 1 to the intermediate transfer belt 25 under constant voltage control that applies a predetermined voltage from the primary transfer power supply 40 to the primary transfer roller 26 based on a surrounding environment, similar advantageous effects to those of the third embodiment are obtained.

When a toner image is primarily transferred under constant voltage control, an appropriate primary transfer voltage can be set by executing voltage setting control that will be described below in pre-rotation operation before image forming operation is performed. First, the controller 102, in the pre-rotation operation, controls the output of the primary transfer power supply 40 such that a predetermined target current flows through the primary transfer roller 26, and obtains a voltage value at the time when the predetermined target current flows through the primary transfer roller 26. After that, the controller 102 sets an appropriate primary transfer voltage based on a surrounding environment by calculation, a look-up table (LUT) of a voltage value stored in the controller 102 in advance, or the like.

In the first to third embodiments, the intermediate transfer-type image forming apparatus 100 using the intermediate transfer belt 25 is described; however, the image forming apparatus is not limited thereto. In a direct transfer-type image forming apparatus including a conveying belt that conveys a transfer material P as well, when control as described in the first to third embodiments is executed at the time of executing the larger gamut technology mode, similar advantageous effects to those of the first to third embodiments are obtained.

Fourth Embodiment

In the first to third embodiments, control over a primary transfer voltage at the time when a toner image is transferred from the photosensitive drum 1 to the intermediate transfer belt 25 in the larger gamut technology mode is described. In contrast to this, in a fourth embodiment, control over a voltage (hereinafter, referred to as secondary transfer voltage) that is applied from the secondary transfer power supply 41 to the secondary transfer roller 11 at the time when a toner image is secondarily transferred from the intermediate transfer belt 25 to the transfer material P in the larger gamut technology mode will be described. In the following description, like reference signs denote portions common to the first to third embodiments, and the description thereof is omitted.

In control over the secondary transfer voltage in the larger gamut technology mode as well, as in the case of control over the primary transfer voltage, the secondary transfer voltage needs to be appropriately controlled to ensure transferability according to the increased toner coverage in the larger gamut technology mode. However, when the secondary transfer voltage is excessively increased, the charge polarity of toner carried on the intermediate transfer belt 25 may reverses because of discharge that occurs at the secondary transfer portion N2. Toner whose charge polarity has reversed at the secondary transfer portion N2 is not secondarily transferred from the intermediate transfer belt 25 to the transfer material P, and remains on the intermediate transfer belt 25. In this case, the transfer efficiency of secondary transfer deteriorates. When the secondary transfer voltage is further increased, a phenomenon that blank spots appear in an image as a result of exposure of the surface of the transfer material P without toner being transferred to the transfer material P at positions where local discharge has occurred (hereinafter, referred to as blank spots) may occur.

For this reason, in the configuration of the fourth embodiment, the temperature and the humidity are detected by the detecting sensor 103 as a detecting unit that detects a surrounding environment, and an optimal secondary transfer voltage is set based on a weight absolute humidity obtained from the detected temperature and humidity. More specifically, in the configuration of the third embodiment, the value of secondary transfer current is set in advance based on the value of weight absolute humidity, and an appropriate secondary transfer voltage is applied from the secondary transfer power supply 41 to the secondary transfer roller 11 based on the value of secondary transfer current.

Table 8 is a table that shows the value of secondary transfer current based on the value of weight absolute humidity. In the fourth embodiment, the values of weight absolute humidity and secondary transfer current are stored in the storage unit of the controller 102 in advance as a look-up table (LUT). As shown in Table 8, for example, when the weight absolute humidity is 3.0 (g/kg), the controller 102 controls the voltage that is applied from the secondary transfer power supply 41 to the secondary transfer roller 11 such that a secondary transfer current of 27 μA flows from the secondary transfer roller 11 toward the intermediate transfer belt 25.

TABLE 8

Set values of secondary transfer current in larger gamut technology mode for Fourth Embodiment

| Weight Absolute Humidity (g/kg) | Secondary Transfer Current (μA) |
|---|---|
| 0 or higher and lower than 5 | 27 |
| 5 or higher and lower than 15 | 29 |
| 15 or higher | 33 |

Next, for a fifth comparative example and the fourth embodiment, the larger gamut technology mode was executed at some weight absolute humidities, and then transfer efficiency and whether there were blank spots were evaluated. In the fifth comparative example, in any environment, the voltage that was applied from the secondary transfer power supply 41 to the secondary transfer roller 11 was controlled such that the secondary transfer current became 29 μA that was the optimal secondary transfer current when the weight absolute humidity was higher than or equal to 5 (g/kg) and lower than 15 (g/kg). The configuration of the fifth comparative example is the same as the fourth embodiment except that the secondary transfer current is not changed based on a weight absolute humidity, so like reference signs denote portions common to the fourth embodiment, and the description thereof is omitted. High-brightness paper GF-0081 (grammage: 81.4 g/m$^2$) made by CANON KABUSHIKI KAISHA was used as the transfer material P at the time of evaluations, and then evaluations were carried out in a state where the image forming parts S were almost new.

Table 9 is a table that shows the evaluation results on the fourth embodiment and the fifth comparative example. Since the differences in transfer efficiency among the colors were small, the transfer efficiency at the time when a toner image primarily transferred to the intermediate transfer belt 25 in the image forming part SC was secondarily transferred to the transfer material P was evaluated. Specifically, the evaluation results are shown in Table 9 where the result that the transfer efficiency at the time when a toner image formed in the image forming part SC is secondarily transferred to the transfer material P is higher than or equal to 96% is "Good", the result that the transfer efficiency is higher than or equal to 92% and lower than 96% is "Not so good", and the result that the transfer efficiency is lower than 92% is "Not good". Evaluations of blank spots are shown in Table 9 where the result that no blank spots occurred is "Not occurred" and the result that blank spots occurred is "Occurred".

TABLE 9

Evaluation results of transfer efficiency and blank spots on the fourth embodiment and the fifth comparative example

| | Weight Absolute Humidity (g/kg) | Transfer Efficiency | Blank Sports |
|---|---|---|---|
| Fourth Embodiment | 0 or higher and lower than 5 | Good | Not occurred |
| | 5 or higher and lower than 15 | Good | Not occurred |
| | 15 or higher | Good | Not occurred |
| Fifth Comparative Example | 0 or higher and lower than 5 | Good | Occurred |
| | 5 or higher and lower than 15 | Good | Not occurred |
| | 15 or higher | Not so good | Not occurred |

As shown in Table 9, with the configuration of the fourth embodiment, when image formation was performed in the larger gamut technology mode, image formation was carried out at good transfer efficiency in any environment, and blank spots were reduced. On the other hand, in the fifth comparative example, sufficient transfer efficiency was not obtained in the environment in which the weight absolute humidity was higher than or equal to 15 (g/kg), and blank spots occurred in the environment in which the weight absolute humidity was lower than 5 (g/kg).

The amount of toner that is carried from the development roller 3 onto the photosensitive drum 1 (hereinafter, simply referred to as toner coverage) varies with the amount of charge of toner per unit mass (hereinafter, referred to as triboelectricity). The toner coverage reduces as the triboelectricity increases; whereas the toner coverage increases as the triboelectricity decreases. The value of triboelectricity varies depending on a surrounding environment. The value of triboelectricity increases as the weight absolute humidity decreases, and decreases as the weight absolute humidity increases. That is, compared to the toner coverage when the weight absolute humidity is higher than or equal to 5 (g/kg) and lower than 15 (g/kg), the toner coverage increases as the weight absolute humidity increases, and decreases as the weight absolute humidity decreases.

Therefore, in the configuration of the fifth comparative example, the toner coverage in the environment in which the weight absolute humidity was higher than or equal to 15 (g/kg) was greater than the toner coverage in the environment in which the weight absolute humidity was higher than or equal to 5 (g/kg) and lower than 15 (g/kg), so the secondary transfer current was not enough, and sufficient transfer efficiency was not obtained. Because the toner coverage in the environment in which the weight absolute humidity was lower than 5 (g/kg) was less than the toner coverage in the environment in which the weight absolute humidity was higher than or equal to 5 (g/kg) and lower than 15 (g/kg), the secondary transfer current was excessive, and blank spots due to discharge occurred.

As described above, with the configuration of the fourth embodiment, the secondary transfer voltage that is applied from the secondary transfer power supply 41 to the secondary transfer roller 11 at the time of transferring a toner image from the photosensitive drum 1 to the intermediate transfer belt 25 in the larger gamut technology mode is controlled based on a surrounding environment of the image forming apparatus 100. Thus, it is possible to reduce a decrease in transferability by reducing a decrease in transfer efficiency and blank spots regardless of a surrounding environment.

Fifth Embodiment

In the fourth embodiment, the configuration for setting the secondary transfer voltage in the larger gamut technology mode is described based on a surrounding environment of the image forming apparatus 100. In contrast to this, in a fifth embodiment, the configuration for setting the secondary transfer voltage in the larger gamut technology mode based on a surrounding environment of the image forming apparatus 100 and a durability of the image forming part S will be described. The configuration of the fifth embodiment is the same as the configuration of the fourth embodiment except that the secondary transfer voltage is set based on a surrounding environment of the image forming apparatus 100 and a durability of the image forming part S. Therefore, in the following description, like reference signs denote portions common to the fourth embodiment, and the description thereof is omitted.

Secondary Transfer Control in Larger Gamut Technology Mode

As described in the fourth embodiment, the secondary transfer voltage in the larger gamut technology mode needs to be appropriately set according to a toner coverage, and the toner coverage varies with triboelectricity. The triboelectricity of toner also varies depending on a durability of the image forming part S. More specifically, as compared to the early stage of service of the image forming part S, the triboelectricity of toner tends to decrease in the late stage of service. For this reason, in the fifth embodiment, an appropriate secondary transfer voltage is set based on a weight absolute humidity obtained from a surrounding environment of the image forming apparatus 100, and a durability of the image forming part S. More specifically, in the configuration of the fifth embodiment, the value of secondary transfer current is set in advance based on a weight absolute humidity and a durability of the image forming part S, and an appropriate secondary transfer voltage is applied from the secondary transfer power supply 41 to the secondary transfer roller 11 based on the value of secondary transfer current.

In the fifth embodiment, the controller 102 integrates a driving duration of each image forming part S from the time when the image forming part S is new, and calculates the durability of each image forming part S where an integrated driving duration determined as a service life is 100%. That is, the durability of each image forming part S is 0% when the image forming part S is new, increases as image formation is performed, and reaches 100% at the end of the service life. In the fifth embodiment, the integrated driving duration of the image forming part S is calculated by the controller 102 each time image formation is complete, and is written into the non-volatile memory (not shown) provided in the image forming part S one by one.

Table 10 is a table that shows the value of secondary transfer current based on a durability of the image forming part S and a weight absolute humidity. In the fifth embodiment, the value of secondary transfer current based on a durability of the image forming part S and a weight absolute humidity is stored in the storage unit of the controller 102 in advance as a look-up table (LUT). As shown in Table 10, for example, when the durability of the image forming unit S is 40% and the weight absolute humidity is 3.0 (g/kg), the controller 102 controls the secondary transfer voltage that is applied from the secondary transfer power supply 41 to the secondary transfer roller 11 such that the secondary transfer current becomes 27 μA.

TABLE 10

Set values of secondary transfer current in larger gamut technology mode for Fifth Embodiment

| | | Durability of Image Forming Part S | | |
|---|---|---|---|---|
| | | 0% or higher and lower than 25% | 25% or higher and lower than 50% | 50% or higher |
| Weight Absolute Humidity (g/kg) | 0 or higher and lower than 5 | 25 μA | 27 μA | 28 μA |
| | 5 or higher and lower than 15 | 28 μA | 29 μA | 30 μA |
| | 15 or higher | 32 μA | 33 μA | 34 μA |

Next, for a sixth comparative example and the fifth embodiment, the larger gamut technology mode was executed at some weight absolute humidities for some durabilities of the image forming part S, and then transfer efficiency and blank spots were evaluated. In the sixth comparative example, in any durability and any environment, the voltage that is applied from the secondary transfer power supply 41 to the secondary transfer roller 11 was controlled such that the secondary transfer current became 29 μA. The set secondary transfer current 29 μA is an optimal value of secondary transfer current when the durability of the image forming part S is 40% and the weight absolute humidity is higher than or equal to 5 (g/kg) and lower than 15 (g/kg) in Table 10. In the following description, like reference signs denote portions common to the fifth embodiment in the configuration of the sixth comparative example, and the description thereof is omitted. The transfer material P and evaluation criteria at the time of evaluations are similar to those of the fourth embodiment, so the description is omitted.

Table 11 is a table that shows the evaluation results of transfer efficiency on the fifth embodiment and the sixth comparative example. Table 12 is a table that shows the evaluation results of blank spots on the fifth embodiment and the sixth comparative example.

TABLE 11

| Evaluation results of transfer efficiency on the fifth embodiment and the sixth comparative example | | | | | |
|---|---|---|---|---|---|
| | | | Durability of Image Forming Part S | | |
| | | | 0% or higher and lower than 25% | 25% or higher and lower than 50% | 50% or higher |
| Fifth Embodiment | Weight Absolute Humidity (g/kg) | 0 or higher and lower than 5 | Good | Good | Good |
| | | 5 or higher and lower than 15 | Good | Good | Good |
| | | 15 or higher | Good | Good | Good |
| Sixth Comparative Example | Weight Absolute Humidity (g/kg) | 0 or higher and lower than 5 | Good | Good | Good |
| | | 5 or higher and lower than 15 | Good | Good | Not so good |
| | | 15 or higher | Not so good | Not so good | Not good |

As shown in Table 11, with the configuration of the fifth embodiment, when image formation was performed in the larger gamut technology mode, image formation was carried out at good transfer efficiency in any durability and any environment. On the other hand, in the sixth comparative example, sufficient transfer efficiency was not obtained in the environment in which the weight absolute humidity was higher than or equal to 15 (g/kg), and the tendency that the transfer efficiency further decreased with an increase in the durability of the image forming part S was observed. This can be understood that, in the environment in which the weight absolute humidity was higher than or equal to 15 (g/kg), the toner coverage increased with a decrease in triboelectricity, the set value of secondary transfer current of the sixth comparative example was insufficient, and, as a result, sufficient transfer efficiency was not obtained. A decrease in transfer efficiency resulting from an increase in durability can be understood that triboelectricity further decreased with an increase in the durability of the image forming part S, the secondary transfer current became more insufficient as a result of a further increase in the toner coverage, and, therefore, sufficient transfer efficiency was not obtained.

TABLE 12

| Evaluation results of blank spots on the fifth embodiment and the sixth comparative example | | | | | |
|---|---|---|---|---|---|
| | | | Durability of Image Forming Part S | | |
| | | | 0% or higher and lower than 25% | 25% or higher and lower than 50% | 50% or higher |
| Fifth Embodiment | Weight Absolute Humidity (g/kg) | 0 or higher and lower than 5 | Not occurred | Not occurred | Not occurred |
| | | 5 or higher and lower than 15 | Not occurred | Not occurred | Not occurred |
| | | 15 or higher | Not occurred | Not occurred | Not occurred |
| Sixth Comparative Example | Weight Absolute Humidity (g/kg) | 0 or higher and lower than 5 | Occurred | Occurred | Occurred |
| | | 5 or higher and lower than 15 | Not occurred | Not occurred | Not occurred |
| | | 15 or higher | Not occurred | Not occurred | Not occurred |

As shown in Table 12, with the configuration of the fifth embodiment, when image formation was performed in the larger gamut technology mode, blank spots were reduced in any durability and any environment. On the other hand, in the sixth comparative example, it was difficult to reduce blank spots in the environment in which the weight absolute humidity was lower than 5 (g/kg). Occurrence of blank spots in the sixth comparative example is understood that the secondary transfer current becomes excessive as a result of a reduction in toner coverage in the environment in which the weight absolute humidity is lower than 5 (g/kg).

As described above, with the configuration of the fifth embodiment, the secondary transfer voltage that is applied from the secondary transfer power supply 41 to the secondary transfer roller 11 in the larger gamut technology mode is controlled based on a durability of the image forming part S and a surrounding environment of the image forming apparatus 100. Thus, it is possible to reduce a decrease in transferability in secondary transfer by reducing a decrease in secondary transfer efficiency and blank spots regardless of a surrounding environment.

In the fifth embodiment, the durability of each image forming part S was obtained by integrating a driving duration of the image forming part S from the time when the image forming part S is new; however, the durability of the image forming part S is not limited thereto. For example, the durability of the image forming part S may be obtained from an integrated value of the number of rotations of the development roller 3 or the amount of toner contained in the developing unit 9. Besides these configurations, the durability of the image forming part S may be obtained from the film thickness of the photosensitive drum 1, an integrated rotating duration of the photosensitive drum 1, a surface moving amount of the photosensitive drum 1, or another parameter.

Sixth Embodiment

In a sixth embodiment, in addition to control of the fifth embodiment, the configuration for setting the secondary transfer voltage that is applied to a rear end portion of the transfer material Pin the conveying direction of the transfer material P when the larger gamut technology mode is executed to a value higher than the secondary transfer voltage that is applied to a center portion of the transfer material P will be described. The sixth embodiment has the same configuration as that of the fifth embodiment except that the secondary transfer voltage is varied between the rear end portion and center portion of the transfer material P in the conveying direction of the transfer material P. Therefore, in the following description, like reference signs denote portions common to the fifth embodiment, and the description thereof is omitted.

Figure 7A:
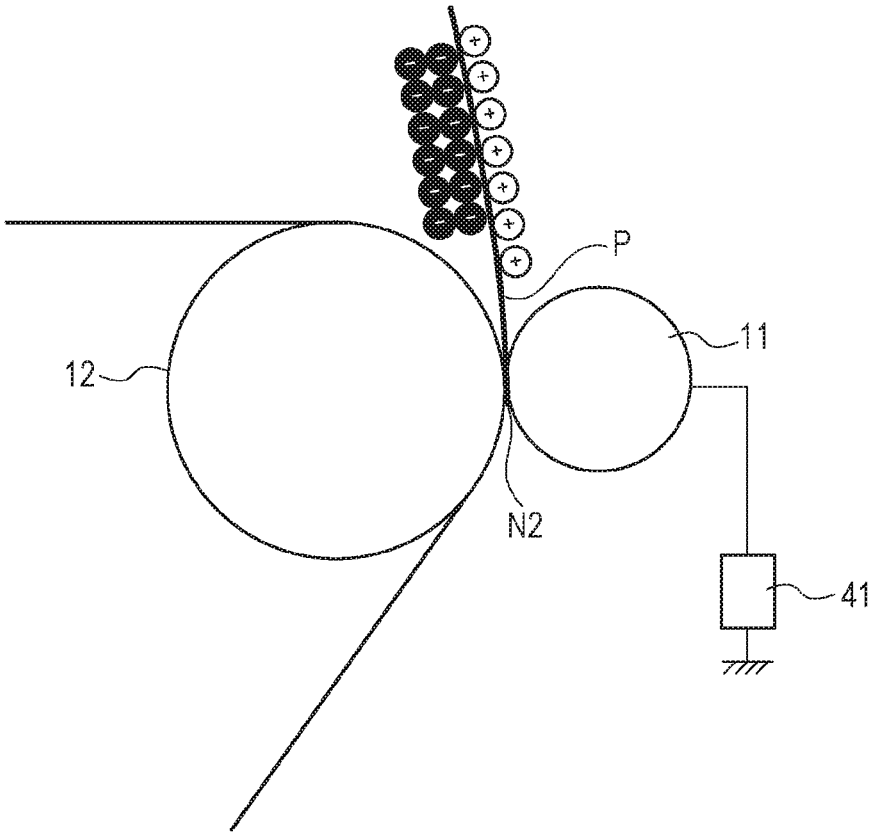
FIG. 7A and FIG. 7B are schematic diagrams that illustrate a defective image that occurs at a secondary transfer portion.
Figure 7B:
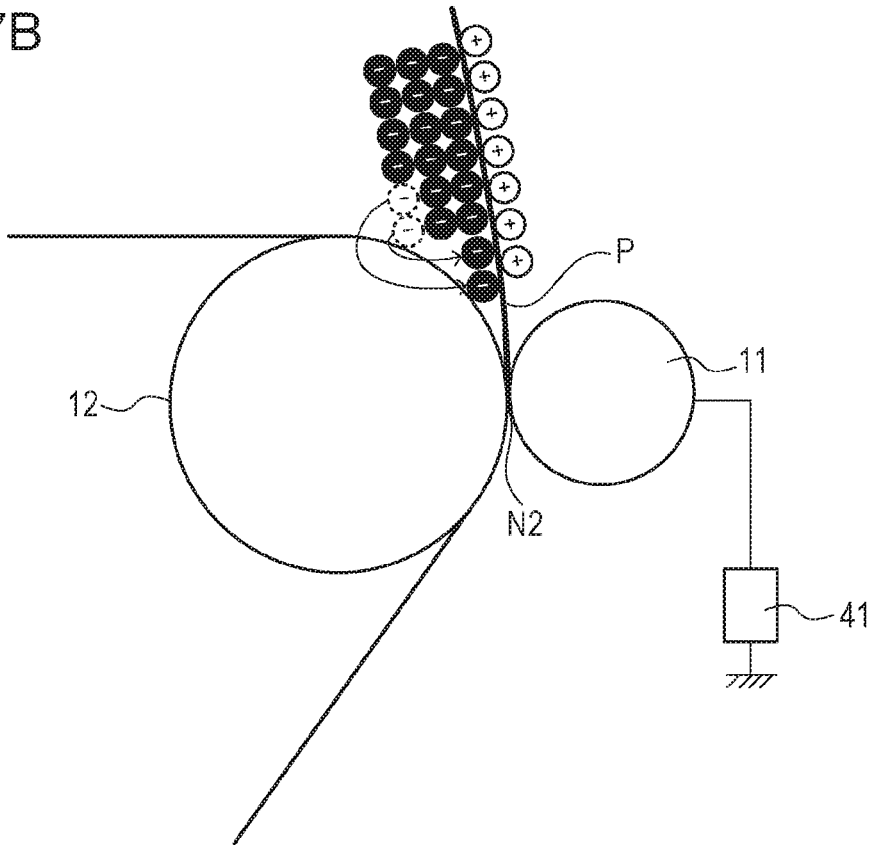

When the larger gamut technology mode is executed, a phenomenon (hereinafter, simply referred to as scattering) that a toner image secondarily transferred to an image area at the rear end of the transfer material P is scattered to a non-image area can occur depending on the value of electrical resistance of the transfer material P. Hereinafter, scattering in the larger gamut technology mode will be described with reference to FIG. 7A and FIG. 7B. FIG. 7A is a schematic view that illustrates a toner image carried at the rear end of the transfer material P at the time of secondary transfer in the normal mode. FIG. 7B is a schematic view that illustrates a toner image carried at the rear end of the transfer material P when scattering has occurred in the larger gamut technology mode.

As shown in FIG. 7A and FIG. 7B, when positive-polarity voltage is applied from the secondary transfer power supply 41 to the secondary transfer roller 11 to secondarily transfer a toner image from the intermediate transfer belt 25 to the transfer material P, positive-polarity electric charge is supplied to the back surface of the transfer material P, facing the secondary transfer roller 11. At this time, when the electric charge supplied to the back surface of the transfer material P is greater than the electric charge held by the toner image to be secondarily transferred, scattering does not occur. However, when a large amount of toner is carried on the intermediate transfer belt 25 as a result of execution of the larger gamut technology mode, the electric charge supplied to the transfer material P can be less than the electric charge held by the toner image. When the electric charge supplied to the transfer material P is less than the electric charge held by the toner image, a phenomenon (hereinafter, referred to as scattering) that toner secondarily transferred to the transfer material P is scattered to a non-image area occurs as shown in FIG. 7B. Particularly, this scattering tends to occur in a low-temperature, low-humidity environment in which the electrical resistance of the transfer material P increases.

Figure 8:
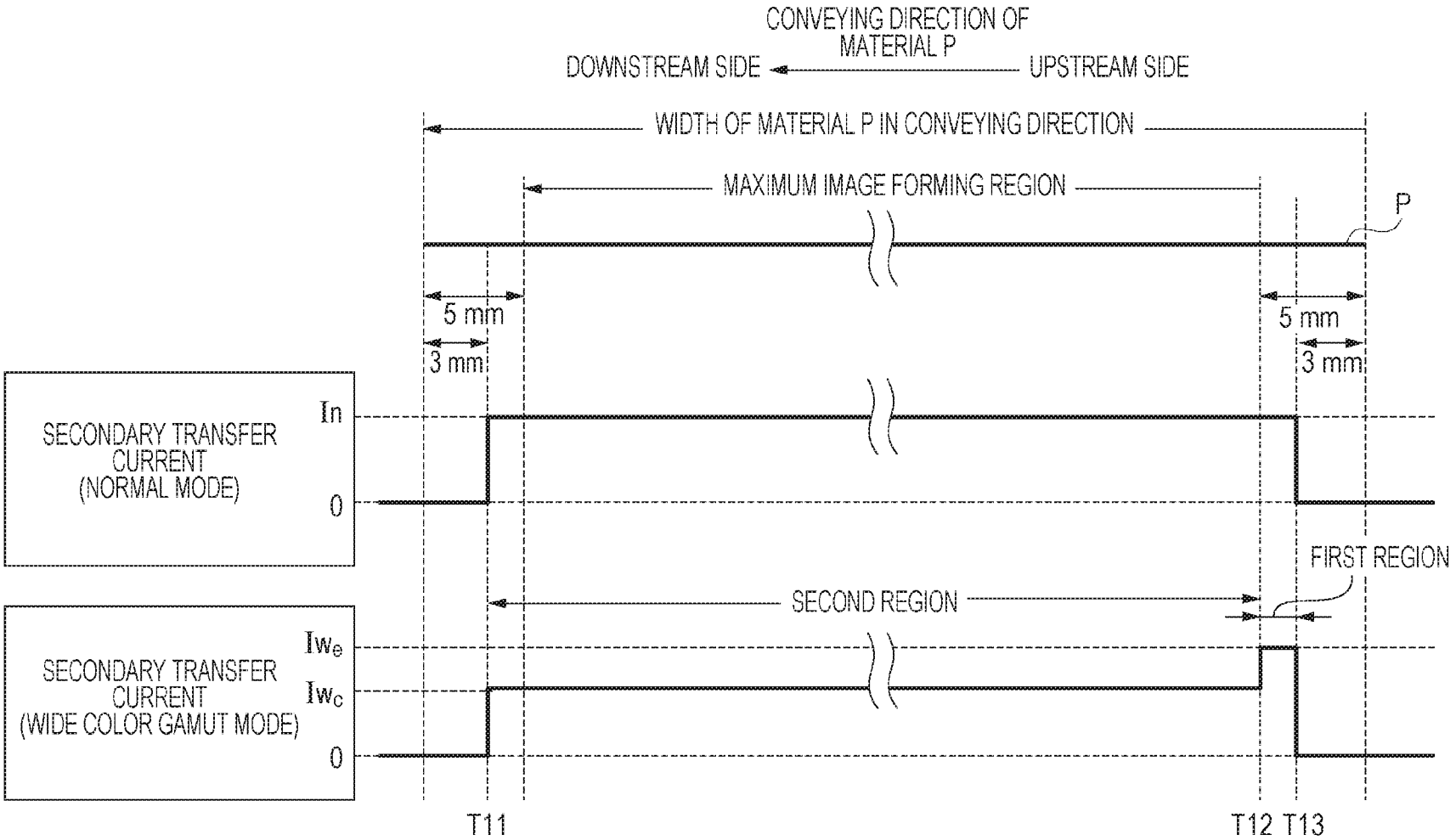
FIG. 8 is a timing chart that illustrates control of a secondary transfer power supply in a sixth embodiment.

For this reason, in the sixth embodiment, when control of the fifth embodiment is executed in the larger gamut technology mode in the low-temperature, low-humidity environment, the secondary transfer voltage that is applied to the rear end portion of the transfer material P in the conveying direction of the transfer material P is set to higher than the secondary transfer voltage that is applied to the center portion of the transfer material P. More specifically, as shown in FIG. 8, the secondary transfer current at the rear end portion (first region) of the transfer material P is set to greater than the secondary transfer current at the center portion (second region) of the transfer material P in the conveying direction of the transfer material P based on a weight absolute humidity and a durability of the image forming part S. FIG. 8 is a timing chart that schematically illustrates control over the secondary transfer power supply 41 in the sixth embodiment.

As shown in FIG. 8, in each of the normal mode and the larger gamut technology mode of the sixth embodiment, the secondary transfer voltage is applied from the secondary transfer power supply 41 to the secondary transfer roller 11 at time T11 before the distal end of a toner image to be secondarily transferred to the transfer material P reaches the secondary transfer portion N2. At this time, the controller 102 controls the value of the output of the secondary transfer power supply 41 such that the secondary transfer current that flows from the secondary transfer roller 11 toward the intermediate transfer belt 25 becomes a current In in the normal mode. In the larger gamut technology mode, the value of the output of the secondary transfer power supply 41 is controlled such that the secondary transfer current becomes a current $Iw_c$ (second current value).

Subsequently, in the larger gamut technology mode, the value of the output of the secondary transfer power supply 41 is controlled such that the secondary transfer current becomes a current $Iw_e$ (first current value) greater than the value of current $Iw_c$ at time T12 at which the rear end of the toner image secondarily transferred to the transfer material P reaches the secondary transfer portion N2. After that, at time T13, application of voltage from the secondary transfer power supply 41 to the secondary transfer roller 11 is stopped, with the result that image formation on the transfer material P in the normal mode or the larger gamut technology mode is complete.

In the configuration of the sixth embodiment, the value of secondary transfer current for the center portion of the transfer material P and the value of secondary transfer current for the rear end portion of the transfer material P are set in advance. When the controller 102 executes the larger gamut technology mode, the controller 102 controls the secondary transfer power supply 41 based on the respective values of secondary transfer current, and applies an appropriate secondary transfer voltage to the secondary transfer roller 11. In the sixth embodiment, the value of secondary transfer current is varied between the center portion and rear end portion of the transfer material Pin the environment in which scattering is more likely to occur, that is, in the environment in which the weight absolute humidity is lower than 5 (g/kg).

Table 13 is a table that shows the value of current $Iw_c$ based on a durability of the image forming part S and a weight absolute humidity. Table 14 is a table that shows the value of $Iw_e$ based on a durability of the image forming part S and a weight absolute humidity. As shown in Table 13 and Table 14, for example, when the durability of the image forming unit S is 40% and the weight absolute humidity is 3 (g/kg), the controller 102 controls the secondary transfer voltage that is applied from the secondary transfer power supply 41 to the secondary transfer roller 11 as in the following manner. That is, the secondary transfer voltage that is applied to the secondary transfer roller 11 is controlled such that the current $Iw_c$ that is the secondary transfer current for the center portion of the transfer material P is 27 μA and the current $Iw_e$ that is the secondary transfer current for the rear end portion of the transfer material P is 32 μA. In the sixth embodiment, switching of the secondary transfer voltage from the voltage for the second region to the voltage for the first region in the larger gamut technology mode was performed 5 mm before the rear end of the transfer material P passes through the secondary transfer portion N2.

TABLE 13

Set values of secondary transfer current (current $Iw_c$) in larger gamut technology mode for the sixth embodiment

| | | Durability of Image Forming Part S | | |
|---|---|---|---|---|
| | | 0% or higher and lower than 25% | 25% or higher and lower than 50% | 50% or higher |
| Weight Absolute Humidity (g/kg) | 0 or higher and lower than 5 | 25 μA | 27 μA | 28 μA |
| | 5 or higher and lower than 15 | 28 μA | 29 μA | 30 μA |
| | 15 or higher | 32 μA | 33 μA | 34 μA |

TABLE 14

Set values of secondary transfer current (current $Iw_e$) in larger gamut technology mode for the sixth embodiment

| | | Durability of Image Forming Part S | | |
|---|---|---|---|---|
| | | 0% or higher and lower than 25% | 25% or higher and lower than 50% | 50% or higher |
| Weight Absolute | 0 or higher and lower than 5 | 30 μA | 32 μA | 34 μA |

TABLE 14-continued

| Set values of secondary transfer current (current $Iw_e$) in larger gamut technology mode for the sixth embodiment | | | | |
|---|---|---|---|---|
| | | Durability of Image Forming Part S | | |
| | | 0% or higher and lower than 25% | 25% or higher and lower than 50% | 50% or higher |
| Humidity (g/kg) | 5 or higher and lower than 15 | 28 μA | 29 μA | 30 μA |
| | 15 or higher | 32 μA | 33 μA | 34 μA |

Next, for a seventh comparative example and the sixth embodiment, the larger gamut technology mode was executed at some weight absolute humidities for some durabilities of the image forming part S, and then blank spots and scattering were evaluated. High-brightness paper GF-0081 (grammage: 81.4 g/m$^2$) made by CANON KABUSHIKI KAISHA was used as the transfer material P, the transfer material P was left standing for four days under some atmosphere environments, then the larger gamut technology mode was executed, and evaluations of blank spots and scattering were carried out.

The seventh comparative example has a configuration in which the value of secondary transfer current is not switched between the center portion and rear end portion of the transfer material P in the environment in which the weight absolute humidity is lower than 5 (g/kg). That is, in the seventh comparative example, the voltage that was applied from the secondary transfer power supply 41 to the secondary transfer roller 11 was controlled such that the secondary transfer current at each of the center portion and rear end portion of the transfer material P became the current $Iw_c$ even in the environment in which the weight absolute humidity was lower than 5 (g/kg). In the following description, like reference signs denote portions common to the sixth embodiment in the configuration of the seventh comparative example, and the description thereof is omitted.

Table 15 is a table that shows the evaluation results of blank spots on the sixth embodiment and the seventh comparative example. Table 16 is a table that shows the evaluation results of scattering on the sixth embodiment and the seventh comparative example. Evaluations of blank spots and scattering are shown in Table 15 or Table 16 where the result that no blank spots occurred is "Not occurred" and the result that blank spots occurred is "Occurred".

TABLE 15

| Evaluation results of blank spots on the sixth embodiment and the seventh comparative example | | | | | |
|---|---|---|---|---|---|
| | | | Durability of Image Forming Part S | | |
| | | | 0% or higher and lower than 25% | 25% or higher and lower than 50% | 50% or higher |
| Sixth Embodiment | Weight Absolute Humidity (g/kg) | 0 or higher and lower than 5 | Not occurred | Not occurred | Not occurred |
| | | 5 or higher and lower than 15 | Not occurred | Not occurred | Not occurred |
| | | 15 or higher | Not occurred | Not occurred | Not occurred |
| Seventh Comparative Example | Weight Absolute Humidity (g/kg) | 0 or higher and lower than 5 | Not occurred | Not occurred | Not occurred |
| | | 5 or higher and lower than 15 | Not occurred | Not occurred | Not occurred |
| | | 15 or higher | Not occurred | Not occurred | Not occurred |

As shown in Table 15, in the configuration of any of the sixth embodiment and the seventh comparative example, no blank spots were found when image formation was performed in the larger gamut technology mode. This is because, in the sixth embodiment and the seventh comparative example, the secondary transfer current in the larger gamut technology mode is set based on a durability of the image forming part S and a surrounding environment of the image forming apparatus 100 and the current that is applied from the secondary transfer power supply 41 to the secondary transfer roller 11 is controlled. With this configuration, it is possible to reduce a decrease in transferability in secondary transfer by reducing a decrease in secondary transfer efficiency and blank spots regardless of a surrounding environment.

TABLE 16

| Evaluation results of scattering on the sixth embodiment and the seventh comparative example | | | | | |
|---|---|---|---|---|---|
| | | | Durability of Image Forming Part S | | |
| | | | 0% or higher and lower than 25% | 25% or higher and lower than 50% | 50% or higher |
| Sixth Embodiment | Weight Absolute Humidity (g/kg) | 0 or higher and lower than 5 | Not occurred | Not occurred | Not occurred |
| | | 5 or higher and lower than 15 | Not occurred | Not occurred | Not occurred |
| | | 15 or higher | Not occurred | Not occurred | Not occurred |
| Seventh Comparative Example | Weight Absolute Humidity (g/kg) | 0 or higher and lower than 5 | Occurred | Occurred | Occurred |
| | | 5 or higher and lower than 15 | Not occurred | Not occurred | Not occurred |
| | | 15 or higher | Not occurred | Not occurred | Not occurred |

As shown in Table 16, in the seventh comparative example, scattering occurred at the rear end portion of the transfer material P in the environment in which the weight absolute humidity was lower than 5 (g/kg). This can be understood that, since the transfer material P was left standing for four days in the environment in which the weight absolute humidity was lower than 5 (g/kg), the electrical resistance of the transfer material P increased, and the electric charge supplied from the secondary transfer roller 11 to the transfer material P became less than the electric charge held by the toner image. In contrast to this, in the configuration of the sixth embodiment in which the value of secondary transfer current for the rear end portion of the transfer material P was made greater than the value of secondary transfer current for the center portion of the transfer material Pin the environment in which the weight absolute humidity was lower than 5 (g/kg), scattering was reduced.

In the sixth embodiment, the value of secondary transfer current for the rear end portion of the transfer material P was increased in the environment in which the weight absolute humidity was lower than 5 (g/kg); however, no blank spots due to excessive secondary transfer current occurred. This can be understood that the first region in which the secondary transfer current is increased includes the rear end of an image forming region to which a toner image is secondarily transferred but the first region is a relatively narrow region like a region within 5 mm from the rear end of the transfer material Pin the conveying direction of the transfer material P.

As described above, in the configuration of the sixth embodiment, the secondary transfer current is set based on a durability of the image forming part S and a surrounding environment, and the secondary transfer current for the rear end portion of the transfer material P is set to greater than the secondary transfer current for the center portion in the conveying direction of the transfer material P. Thus, not only similar advantageous effects to those of the fifth embodiment are obtained but also scattering at the rear end portion of the transfer material P can be reduced.

Description is made on the assumption of the configuration of the fifth embodiment in which the secondary transfer current is set based on a durability of the image forming part S and a surrounding environment; however, the configuration is not limited thereto. When the configuration is intended to reduce scattering at the secondary transfer portion N2, the secondary transfer current for the rear end portion of the transfer material P just needs to be at least set to greater than the secondary transfer current for the center portion of the transfer material P in the conveying direction of the transfer material P. Alternatively, the configuration for setting the secondary transfer current for the rear end portion of the transfer material P to greater than the secondary transfer current for the center portion of the transfer material P may be applied to the configuration of the fourth embodiment for setting the secondary transfer current based on a surrounding environment. Thus, not only similar advantageous effects to those of the fourth embodiment are obtained but also scattering is reduced in the configuration of the fourth embodiment.

In the sixth embodiment, the configuration for switching the value of the secondary transfer current for the region within 5 mm from the rear end of the transfer material P is described; however, the configuration is not limited thereto. At least the rear end of an image forming region to which a toner image is secondarily transferred is included and an upstream region where a toner image transferred to the rear end of the image forming region in the conveying direction of the transfer material P can scatter is included, scattering can be reduced. That is, the value of secondary transfer current may be switched on the downstream side of the rear end of the image forming region in the conveying direction of the transfer material P. However, when the first region is set so as to be excessively wide, blank spots due to a large value of secondary transfer current can occur. The first region may include the rear end of the image forming region, and the width of the first region may be set so as to be narrower than the width of the second region in the conveying direction of the transfer material P.

In the sixth embodiment, the durability of each image forming part S was obtained by integrating a driving duration of the image forming part S from the time when the image forming part S is new; however, the durability of the image forming part S is not limited thereto. For example, the durability of the image forming part S may be obtained from an integrated value of the number of rotations of the development roller 3 or the amount of toner contained in the developing unit 9. Besides these configurations, the durability of the image forming part S may be obtained from the film thickness of the photosensitive drum 1, an integrated rotating duration of the photosensitive drum 1, a surface moving amount of the photosensitive drum 1, or another parameter.

Modifications

In the sixth embodiment, the configuration for switching the value of secondary transfer current between the center portion and rear end portion of the transfer material P in the environment in which the weight absolute humidity is lower than 5 (g/kg) where the electrical resistance of the transfer material P increases is described. This is because, when the electrical resistance of the transfer material P is high, the amount of electric charge that is supplied from the secondary transfer roller 11 to the transfer material P reduces and, as a result, the possibility of scattering increases. The amount of electric charge that is supplied from the secondary transfer roller 11 to the transfer material P also depends on the orientation of the rear end portion of the transfer material P at the secondary transfer portion N2. Hereinafter, description will be made in detail.

Figure 9A:
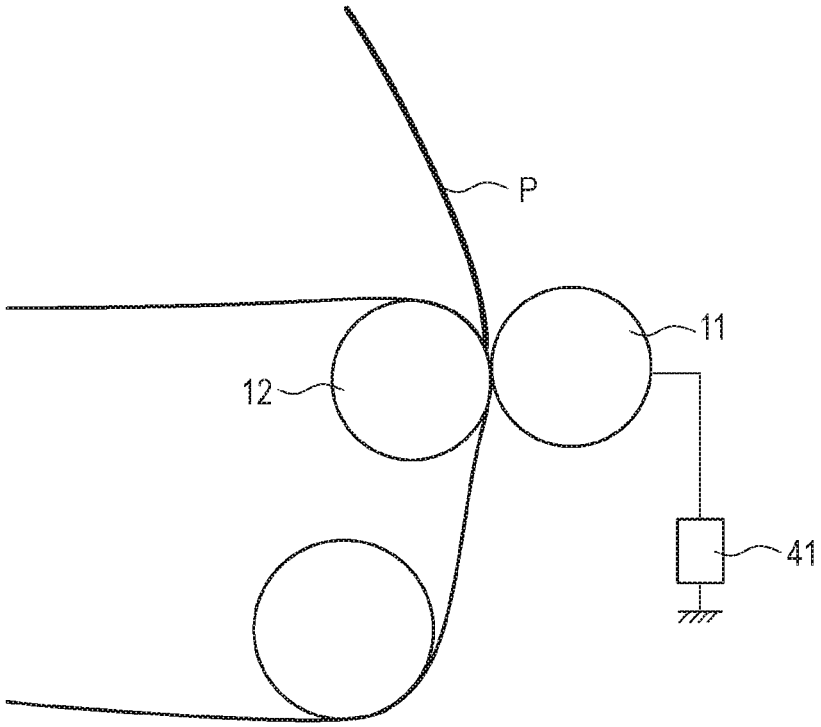
FIG. 9A and FIG. 9B are schematic diagrams that illustrate the amount of electric charge that is supplied to a rear end of a transfer material, to which an image is to be transferred, at the secondary transfer portion in a modification example.
Figure 9B:
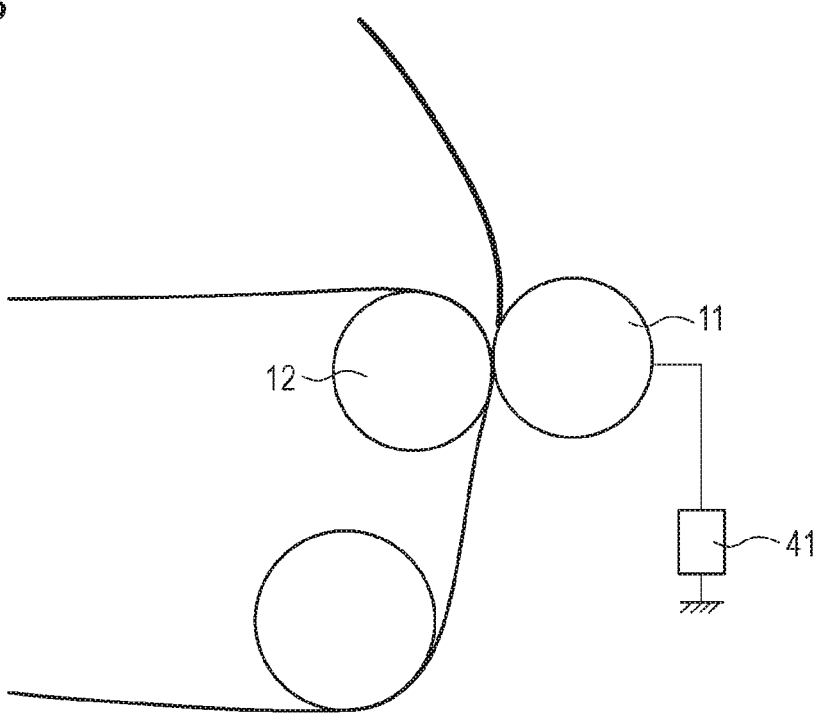

FIG. 9A is a schematic diagram that illustrates a state where, when the transfer material P passes through the secondary transfer portion N2, the rear end of the transfer material Pin the conveying direction of the transfer material P comes out to the intermediate transfer belt 25 side. FIG. 9B is a schematic diagram that illustrates a state where, when the transfer material P passes through the secondary transfer portion N2, the rear end of the transfer material P in the conveying direction of the transfer material P comes out to the secondary transfer roller 11 side.

In the environment in which the weight absolute humidity is low (low-temperature, low-humidity environment), discharge is predominant in supply of electric charge from the secondary transfer roller 11 to the transfer material P. That is, as shown in FIG. 9A, in a state where the rear end of the transfer material P moves to the intermediate transfer belt 25 side, discharge from the secondary transfer roller 11 to the back surface of the transfer material P increases, so the amount of electric charge that is supplied from the secondary transfer roller 11 to the transfer material P also increases. On the other hand, as shown in FIG. 9B, in a state where the rear end of the transfer material P moves to the secondary transfer roller 11 side, discharge from the secondary transfer roller 11 to the back surface of the transfer material P reduces, so the amount of electric charge that is supplied from the secondary transfer roller 11 to the transfer material P also reduces.

When the transfer material P is conveyed in the orientation shown in FIG. 9B, scattering can occur at the rear end of the transfer material P. Specifically, when a toner image is secondarily transferred to a first surface of the transfer material P at the secondary transfer portion N2, the toner image is fixed to the first surface in the fixing unit 13, and then the transfer material P is conveyed to the secondary transfer portion N2 again through a double-sided conveying path, the transfer material P tends to be in the orientation shown in FIG. 9B. This is because the transfer material P can curl at the time of passing through the double-sided conveying path.

In the sixth embodiment, regardless of the first surface or second surface of the transfer material P, when the larger gamut technology mode was executed in the environment in which the weight absolute humidity was lower than 5 (g/kg), the secondary transfer power supply 41 was controlled such that the current $Iw_e$ greater than the value of current $Iw_c$ flowed through the rear end portion of the transfer material P. However, the configuration is not limited thereto. Only when the larger gamut technology mode is executed and a toner image is secondarily transferred to the second surface of the transfer material P, the secondary transfer power supply 41 may be controlled such that the current $Iw_e$ greater than the value of current $Iw_c$ flows through the rear end portion of the transfer material P. With such a configuration as well, similar advantageous effects to those of the sixth embodiment are obtained.

Seventh Embodiment

In the sixth embodiment, the configuration for reducing scattering at the rear end portion of the transfer material P by setting the secondary transfer current for the rear end portion of the transfer material P to greater than the secondary transfer current for the center portion of the transfer material P in the conveying direction of the transfer material P is described. In contrast to this, in a seventh embodiment, the configuration for, when the larger gamut technology mode is executed in the environment in which the weight absolute humidity is low (low-temperature, low-humidity environment), delaying the timing of turning off the output of the secondary transfer power supply 41 as compared to the normal mode will be described. The seventh embodiment has the same configuration as the sixth embodiment except that the secondary transfer current is not switched between the center portion and rear end portion of the transfer material P but the timing of turning off the output of the secondary transfer power supply 41 is varied. Therefore, in the following description, like reference signs denote portions common to the sixth embodiment, and the description thereof is omitted.

Figure 10:
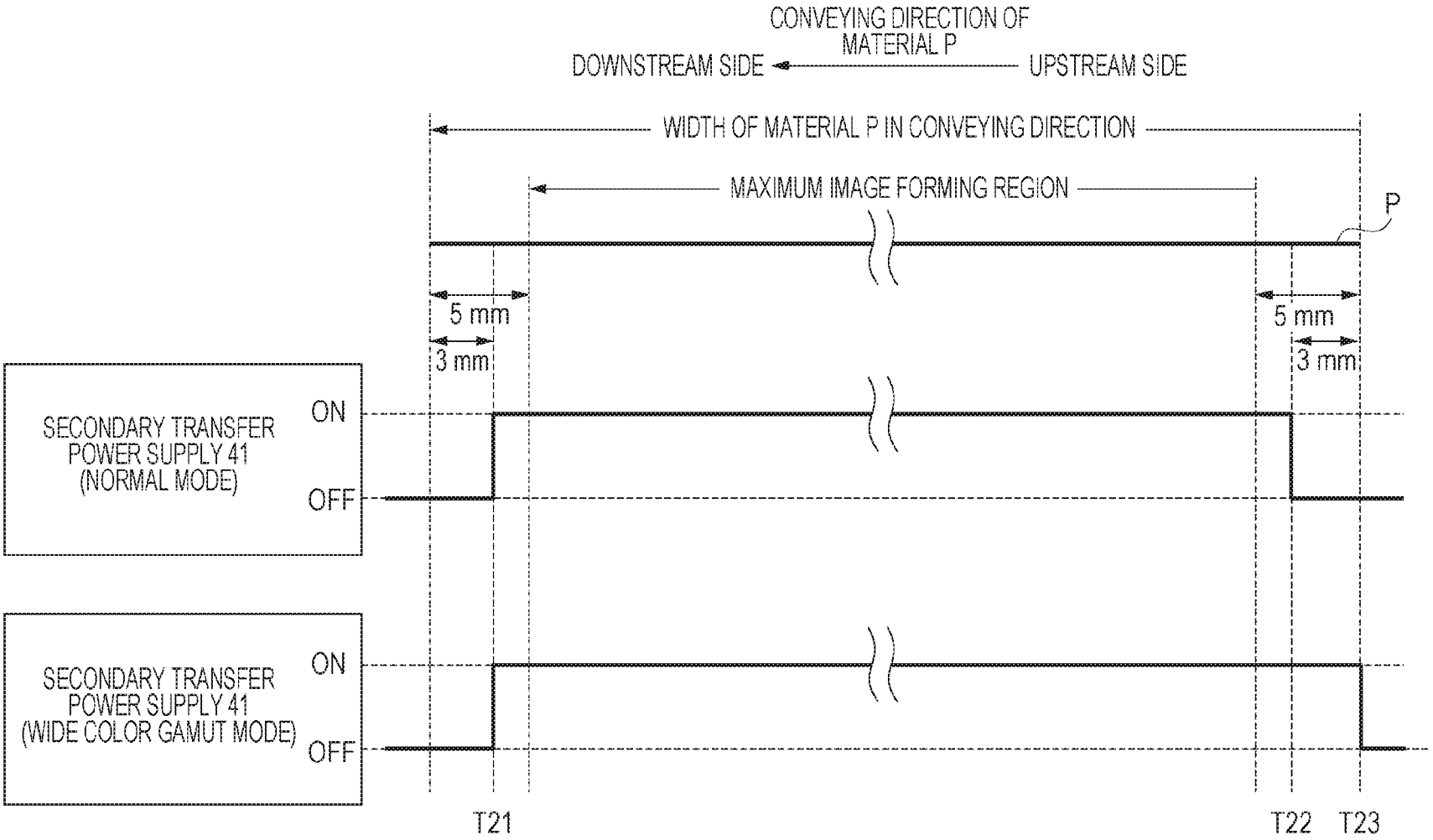
FIG. 10 is a timing chart that illustrates control of the secondary transfer power supply in a seventh embodiment.

FIG. 10 is a schematic timing chart that illustrates control over the secondary transfer power supply 41 in the seventh embodiment. As shown in FIG. 10, in each of the normal mode and the larger gamut technology mode of the seventh embodiment, the secondary transfer voltage is applied from the secondary transfer power supply 41 to the secondary transfer roller 11 at time T21 before the distal end of a toner image to be secondarily transferred to the transfer material P reaches the secondary transfer portion N2. Subsequently, in the normal mode, at time T22 after the rear end of the toner image to be secondarily transferred to the transfer material P passes through the secondary transfer portion N2, application of voltage from the secondary transfer power supply 41 to the secondary transfer roller 11 is stopped, and image formation on the transfer material P is complete. In contrast to this, in the larger gamut technology mode, at time T23 later than time T22, application of voltage from the secondary transfer power supply 41 to the secondary transfer roller 11 is stopped, and image formation on the transfer material P is complete.

As described in the sixth embodiment, discharge is predominant in supply of electric charge from the secondary transfer roller 11 to the transfer material P in the low-temperature, low-humidity environment in which the weight absolute humidity is low, and the amount of electric charge that is supplied to the transfer material P reduces as a result of a reduction of discharge to the back surface of the transfer material P at the rear end portion of the transfer material P. In the seventh embodiment, in light of this point, the amount of electric charge that is supplied to the transfer material P at the rear end portion of the transfer material P is compensated by delaying the timing of turning off the output of the secondary transfer power supply 41 in the larger gamut technology mode as compared to the normal mode.

The value of secondary transfer current in the larger gamut technology mode in the seventh embodiment is set in advance based on a weight absolute humidity and a durability of the image forming part S. The value of secondary transfer current is the same as the value shown in Table 13 in the sixth embodiment, so the description is omitted. When the controller 102 executes the larger gamut technology mode, the controller 102 controls the secondary transfer power supply 41 based on the respective values of secondary transfer current, and applies an appropriate secondary transfer voltage to the secondary transfer roller 11. In the seventh embodiment, control for switching the value of secondary transfer current between the center portion and rear end portion of the transfer material P as described in the sixth embodiment is not executed.

Next, for an eighth comparative example and the seventh embodiment, the larger gamut technology mode was executed at some weight absolute humidities for some durabilities of the image forming part S, and then blank spots and scattering were evaluated. High-brightness paper GF-0081 (grammage: 81.4 g/m$^2$) made by CANON KABUSHIKI KAISHA was used as the transfer material P, the transfer material P was left standing for four days under some atmosphere environments, then the larger gamut technology mode was executed, and evaluations of blank spots and scattering were carried out.

In the configuration of the eighth comparative example, the controller 102 controls the secondary transfer power supply 41 such that the timing of turning off the output of the secondary transfer power supply 41 at the rear end portion of the transfer material P in the conveying direction of the transfer material P is the same timing between the normal mode and the larger gamut technology mode. In the following description, like reference signs denote portions common to the seventh embodiment in the configuration of the eighth comparative example, and the description thereof is omitted.

Table 17 is a table that shows the evaluation results of blank spots on the seventh embodiment and the eighth comparative example. Table 18 is a table that shows the evaluation results of scattering on the seventh embodiment and the eighth comparative example. Evaluations of blank spots and scattering are shown in Table 17 or Table 18 where the result that no blank spots occurred is "Not occurred" and the result that blank spots occurred is "Occurred".

TABLE 17

| Evaluation results of blank spots on the seventh embodiment and the eighth comparative example | | | | | |
|---|---|---|---|---|---|
| | | | Durability of Image Forming Part S | | |
| | | | 0% or higher and lower than 25% | 25% or higher and lower than 50% | 50% or higher |
| Seventh Embodiment | Weight Absolute Humidity (g/kg) | 0 or higher and lower than 5 | Not occurred | Not occurred | Not occurred |
| | | 5 or higher and lower than 15 | Not occurred | Not occurred | Not occurred |
| | | 15 or higher | Not occurred | Not occurred | Not occurred |
| Eighth Comparative Example | Weight Absolute Humidity (g/kg) | 0 or higher and lower than 5 | Not occurred | Not occurred | Not occurred |
| | | 5 or higher and lower than 15 | Not occurred | Not occurred | Not occurred |
| | | 15 or higher | Not occurred | Not occurred | Not occurred |

As shown in Table 17, in the seventh embodiment, the timing of turning off the output of the secondary transfer power supply 41 in the larger gamut technology mode was delayed as compared to the normal mode; however, no blank spots due to an excessive secondary transfer current were found. In the configuration of the eighth comparative example, no blank spots were found when image formation was performed in the larger gamut technology mode. In the seventh embodiment and the eighth comparative example, the secondary transfer current in the larger gamut technology mode is set based on a durability of the image forming part S and a surrounding environment of the image forming apparatus 100 and the current that is applied from the secondary transfer power supply 41 to the secondary transfer roller 11 is controlled. With this configuration, it is possible to reduce a decrease in transferability in secondary transfer by reducing a decrease in secondary transfer efficiency and blank spots regardless of a surrounding environment.

TABLE 18

| Evaluation results of scattering on the seventh embodiment and the eighth comparative example | | | | | |
|---|---|---|---|---|---|
| | | | Durability of Image Forming Part S | | |
| | | | 0% or higher and lower than 25% | 25% or higher and lower than 50% | 50% or higher |
| Seventh Embodiment | Weight Absolute Humidity (g/kg) | 0 or higher and lower than 5 | Not occurred | Not occurred | Not occurred |
| | | 5 or higher and lower than 15 | Not occurred | Not occurred | Not occurred |
| | | 15 or higher | Not occurred | Not occurred | Not occurred |
| Eighth Comparative Example | Weight Absolute Humidity (g/kg) | 0 or higher and lower than 5 | Occurred | Occurred | Occurred |
| | | 5 or higher and lower than 15 | Not occurred | Not occurred | Not occurred |
| | | 15 or higher | Not occurred | Not occurred | Not occurred |

As shown in Table 18, in the eighth comparative example, scattering occurred at the rear end portion of the transfer material P in the environment in which the weight absolute humidity was lower than 5 (g/kg). This can be understood that, since the transfer material P was left standing for four days in the environment in which the weight absolute humidity was lower than 5 (g/kg), the electrical resistance of the transfer material P increased, and the electric charge supplied from the secondary transfer roller 11 to the transfer material P became less than the electric charge held by the toner image. In contrast to this, in the configuration of the seventh embodiment in which the timing of turning off the output of the secondary transfer power supply 41 when the larger gamut technology mode is executed is delayed as compared to when the normal mode is executed, scattering was reduced.

The timing of turning off the output of the secondary transfer power supply 41 in the larger gamut technology mode may be set to the position of the rear end of the transfer material P or on the downstream side of the rear ed of the transfer material P in the conveying direction of the transfer material P. In the case of turning off the output of the secondary transfer power supply 41 after the rear end of the transfer material P passes through the secondary transfer portion N2, current flows from the secondary transfer roller 11 toward the intermediate transfer belt 25 via the transfer material P. At this time, electrostatic history due to the secondary transfer current remains on the intermediate transfer belt 25, and this may cause a defective image at the time of the next image formation. When toner, or the like, having passed through a cleaning part remains on the intermediate transfer belt 25, the toner may adhere to the secondary transfer roller 11 because of flow of the secondary transfer current without passing through the transfer material P, and, as a result, the back surface of the transfer material P may be smeared at the time of the next image formation.

As described above, in the configuration of the seventh embodiment, the secondary transfer current is set based on a durability of the image forming part S and a surrounding environment, and the timing of turning off the output of the secondary transfer power supply 41 in the larger gamut technology mode is delayed as compared to the normal mode. Thus, not only similar advantageous effects to those of the fifth embodiment are obtained but also scattering at the rear end portion of the transfer material P can be reduced.

In the seventh embodiment, description is made on the assumption of the configuration of the fifth embodiment in which the secondary transfer current is set based on a durability of the image forming part S and a surrounding environment; however, the configuration is not limited thereto. The configuration for delaying the timing of turning off the output of the secondary transfer power supply 41 in the larger gamut technology mode as compared to the normal mode may be applied to the configuration of the seventh embodiment for setting the secondary transfer current based on a surrounding environment. Thus, not only similar advantageous effects to those of the seventh embodiment are obtained but also scattering is reduced in the configuration of the seventh embodiment.

In the seventh embodiment, the durability of each image forming part S was obtained by integrating a driving duration of the image forming part S from the time when the image forming part S is new; however, the durability of the image forming part S is not limited thereto. For example, the durability of the image forming part S may be obtained from an integrated value of the number of rotations of the development roller 3 or the amount of toner contained in the developing unit 9. Besides these configurations, the durability of the image forming part S may be obtained from the film thickness of the photosensitive drum 1, an integrated rotating duration of the photosensitive drum 1, a surface moving amount of the photosensitive drum 1, or another parameter.

In the above-descried fourth to seventh embodiments, the configuration of constant current control for, at the time when a toner image is secondarily transferred to the transfer material P, controlling the output of the secondary transfer power supply 41 based on a surrounding environment such that a predetermined current set in advance flows from the secondary transfer roller 11 toward the photosensitive drum 1 is described. However, the configuration is not limited thereto. With a configuration in which a toner image is secondarily transferred from the intermediate transfer belt 25 to the transfer material P under constant voltage control that applies a predetermined voltage from the secondary transfer power supply 41 to the secondary transfer roller 11 based on a surrounding environment, similar advantageous effects to those of the seventh embodiment are obtained.

When a toner image is secondarily transferred under constant voltage control, an appropriate secondary transfer voltage can be set by executing voltage setting control that will be described below in pre-rotation operation before image forming operation is performed. First, the controller 102, in the pre-rotation operation, controls the output of the secondary transfer power supply 41 such that a predetermined target current flows through the secondary transfer roller 11, and obtains a voltage value at the time when the predetermined target current flows through the secondary transfer roller 11. After that, the controller 102 sets an appropriate secondary transfer voltage based on a surrounding environment by calculation, a look-up table (LUT) of a voltage value stored in the controller 102 in advance, or the like. In the fourth to seventh embodiments, control over the secondary transfer voltage is mainly described; however, control over the secondary transfer voltage of the seventh embodiment may be executed in combination with control over the primary transfer voltage as described in the first to third embodiments. With such a configuration, a decrease in transferability is reduced for both primary transfer and secondary transfer.

In the seventh embodiment, the configuration of constant current control for, at the time when a toner image is secondarily transferred to the transfer material P, controlling the output of the secondary transfer power supply 41 based on a surrounding environment such that a predetermined current set in advance flows from the secondary transfer roller 11 to the intermediate transfer belt 25 is described. However, the configuration is not limited thereto. With a configuration in which a toner image is secondarily transferred from the intermediate transfer belt 25 to the transfer material P under constant voltage control that applies a predetermined voltage from the secondary transfer power supply 41 to the secondary transfer roller 11 based on a surrounding environment, similar advantageous effects to those of the seventh embodiment are obtained.

In the first to seventh embodiments, for the second speed ratio that is the ratio of the rotation speed of the development roller 3 to the rotation speed of the photosensitive drum 1 in the larger gamut technology mode, as long as the second speed ratio is higher than the first speed ratio in the normal mode, any one of the rotation speed of the development roller 3 and the rotation speed of the photosensitive drum 1 may be changed. For example, the second speed ratio may be set by decreasing the rotation speed of the photosensitive drum 1 in the larger gamut technology mode relative to the rotation speed of the photosensitive drum 1 in the normal mode without changing the rotation speed of the development roller 3. Alternatively, the second speed ratio may be set by increasing the rotation speed of the development roller 3 in the larger gamut technology mode relative to the rotation speed of the development roller 3 in the normal mode without changing the rotation speed of the photosensitive drum 1.

In the first to seventh embodiments, the configuration for obtaining a weight absolute humidity based on the temperature and humidity of a surrounding environment, detected by the detecting sensor 103, and setting a primary transfer voltage based on the obtained weight absolute humidity is described; however, the configuration is not limited thereto. For example, the configuration for setting a primary transfer voltage based on the temperature and humidity of a surrounding environment, detected by the detecting sensor 103, may be employed. In this case, a look-up table (LUT) for a primary transfer voltage based on the temperature and humidity of a surrounding environment just needs to be stored in the controller 102 in advance. A method of acquiring information about the temperature and humidity of a surrounding environment does not always need to use the detecting sensor 103. For example, the configuration for obtaining information about the temperature and humidity of a surrounding environment from an image formation condition, or the like, that is input from the host computer 101 to the controller 102 may be employed, or the configuration for inputting the temperature and humidity of a surrounding environment to the image forming apparatus 100 by a user may be employed.

The units described throughout the present disclosure are exemplary and/or preferable modules for implementing processes described in the present disclosure. The term "unit", as used herein, may generally refer to firmware, software, hardware, or other component, such as circuitry or the like, or any combination thereof, that is used to effectuate a purpose. The modules can be hardware units (such as circuitry, firmware, a field programmable gate array, a digital signal processor, an application specific integrated circuit, or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

Other Embodiments

Embodiment(s) of the present disclosure can also be realized by a computerized configuration(s) of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computerized configuration(s) of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computerized configuration(s) may comprise one or more processors, one or more memories, circuitry, or a combination thereof (e.g., central processing unit (CPU), micro processing unit (MPU), or the like), and may include a network of separate computers or separate processors to read out and execute the computer executable instructions. The computer executable instructions may be provided to the computerized configuration(s), for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Applications No. 2018-143285, filed Jul. 31, 2018 and No. 2018-143286, filed Jul. 31, 2018 which are hereby incorporated by reference herein in their entirety.

What is claimed is:

1. An image forming apparatus comprising:

an image bearing member configured to bear a toner image;

a developing unit including a developing member disposed to face the image bearing member, and configured to develop an electrostatic latent image, formed on the image bearing member, with toner;

a movable belt configured to come into contact with the image bearing member;

a transfer member provided at a position corresponding to the image bearing member with the belt interposed between the transfer member and the image bearing member, the transfer member being configured to transfer a toner image from the image bearing member to the belt;

a transfer power supply configured to apply voltage to the transfer member; and a control unit configured to execute a first mode and a second mode, the first mode being a mode in which the control unit performs image formation by controlling a speed ratio of a rotation speed of the developing member to a rotation speed of the image bearing member such that the speed ratio becomes a first speed ratio, the second mode being a mode in which the control unit performs image formation by controlling the speed ratio of the rotation speed of the developing member to the rotation speed of the image bearing member such that the speed ratio becomes a second speed ratio higher than the first speed ratio, wherein in a case where the control unit executes the second mode, the control unit controls voltage that is applied from the transfer power supply to the transfer member such that a value of current flowing from the transfer member toward the image bearing member when a surrounding environment of the image forming apparatus is a first environment is greater than a value of current flowing from the transfer member toward the image bearing member when the surrounding environment is a second environment that is lower in humidity than the first environment.

2. The image forming apparatus according to claim 1, wherein the control unit is configured to, in a same surrounding environment, control the voltage that is applied from the transfer power supply to the transfer member such that the value of current flowing from the transfer member toward the image bearing member in the second mode is greater than the value of current flowing from the transfer member toward the image bearing member in the first mode.

3. The image forming apparatus according to claim 1, further comprising:

a detecting unit configured to detect a temperature and a humidity in the surrounding environment, wherein in a case where the control unit executes the second mode, the control unit controls the voltage applied from the transfer power supply to the transfer member based on the temperature and the humidity which is detected by the detecting unit.

4. The image forming apparatus according to claim 3, wherein in a case where the control unit executes the second mode, the control unit controls the voltage that is applied from the transfer power supply to the transfer member such that a current set based on an absolute humidity that is obtained from the temperature and the humidity, detected by the detecting unit, flows from the transfer member toward the image bearing member.

5. The image forming apparatus according to claim 1, wherein the control unit controls the voltage that is applied from the transfer power supply to the transfer member based on information about durability and the surrounding environment, and the information about durability is obtained from at least one of the image bearing member and the developing unit.

6. The image forming apparatus according to claim 1, wherein the control unit controls the voltage that is applied from the transfer power supply to the transfer member such that a ratio of the value of current flowing from the transfer member toward the image bearing member in the first mode to the value of current flowing from the transfer member toward the image bearing member in the second mode is lower than a ratio of an amount of toner that is born on the image bearing member per unit area in the first mode to an amount of toner that is born on the image bearing member per unit area in the second mode.

7. The image forming apparatus according to claim 1, further comprising:

a charging member configured to charge the image bearing member;

a charging power supply configured to apply voltage to the charging member;

an exposing unit configured to form a latent image potential at a position to form the electrostatic latent image by exposing the image bearing member charged by the charging member; and a development power supply configured to apply the developing member with development voltage for developing the electrostatic latent image with toner, wherein the control unit controls an output of the charging power supply such that a second potential difference that is formed between the latent image potential and the development voltage in the second mode is greater than a first potential difference that is formed between the latent image potential and the development voltage in the first mode.

8. The image forming apparatus according to claim 7, wherein an absolute value of voltage that is applied from the charging power supply to the charging member in the second mode is higher than an absolute value of voltage that is applied from the charging power supply to the charging member in the first mode.

9. The image forming apparatus according to claim 1, wherein the belt is an intermediate transfer belt, and the toner image born on the image bearing member is primarily transferred from the image bearing member to the intermediate transfer belt and then secondarily transferred from the intermediate transfer belt to a transfer material.

10. The image forming apparatus according to claim 1, wherein the belt is a conveying belt configured to convey a transfer material, and the toner image born on the image bearing member is transferred to the transfer material that is conveyed by the conveying belt.

11. The image forming apparatus according to claim 1, wherein the control unit is configured to execute the second mode with the second speed ratio set to a constant value regardless of the surrounding environment.

12. An image forming apparatus comprising:

an image bearing member configured to bear a toner image;

a developing unit including a developing member disposed to face the image bearing member, the developing unit being configured to develop an electrostatic latent image, formed on the image bearing member, with toner;

an intermediate transfer member to which a toner image born on the image bearing member is primarily transferred;

a transfer member configured to come into contact with the intermediate transfer member to form a transfer portion, the transfer member being configured to secondarily transfer the toner image, primarily transferred from the image bearing member to the intermediate transfer member, from the intermediate transfer member to a transfer material;

a transfer power supply configured to apply voltage to the transfer member; and a control unit configured to execute a first mode and a second mode, the first mode being a mode in which the control unit performs image formation by controlling a speed ratio of a rotation speed of the developing member to a rotation speed of the image bearing member such that the speed ratio becomes a first speed ratio, the second mode being a mode in which the control unit performs image formation by controlling the speed ratio of the rotation speed of the developing member to the rotation speed of the image bearing member such that the speed ratio becomes a second speed ratio higher than the first speed ratio, wherein the control unit is configured to, in the second mode, control voltage that is applied from the transfer power supply to the transfer member such that a value of current flowing from the transfer member toward the intermediate transfer member, when a surrounding environment of the image forming apparatus is a first environment, is greater than a value of current flowing from the transfer member toward the intermediate transfer member when the surrounding environment is a second environment that is lower in humidity than the first environment.

13. The image forming apparatus according to claim 12, wherein in a same surrounding environment, the control unit controls the voltage that is applied from the transfer power supply to the transfer member such that the value of current flowing from the transfer member toward the intermediate transfer member in the second mode is greater than the value of current flowing from the transfer member toward the intermediate transfer member in the first mode.

14. The image forming apparatus according to claim 12, further comprising:

a detecting unit configured to detect a temperature and a humidity in the surrounding environment, wherein in a case the control unit executes the second mode, the control unit controls the voltage that is applied from the transfer power supply to the transfer member based on the temperature and the humidity, detected by the detecting unit.

15. The image forming apparatus according to claim 14, wherein the control unit is configured to, in a case where the control unit executes the second mode, control the voltage that is applied from the transfer power supply to the transfer member such that a current set based on an absolute humidity that is obtained from the temperature and the humidity, detected by the detecting unit, flows from the transfer member toward the intermediate transfer member.

16. The image forming apparatus according to claim 12, wherein the control unit controls the voltage that is applied from the transfer power supply to the transfer member based on information about durability and the surrounding environment, and the information about durability is obtained from at least one of the image bearing member and the developing unit.

17. The image forming apparatus according to claim 12, wherein a charging member configured to charge the image bearing member;

a charging power supply configured to apply voltage to the charging member;

an exposing unit configured to form a latent image potential at a position to form the electrostatic latent image by exposing the image bearing member charged by the charging member; and a development power supply configured to apply the developing member with development voltage for developing the electrostatic latent image with toner, wherein the control unit controls an output of the charging power supply such that a second potential difference that is formed between the latent image potential and the development voltage in the second mode is greater than a first potential difference that is formed between the latent image potential and the development voltage in the first mode.

18. The image forming apparatus according to claim 17, wherein an absolute value of voltage that is applied from the charging power supply to the charging member in the second mode is higher than an absolute value of voltage that is applied from the charging power supply to the charging member in the first mode.

19. The image forming apparatus according to claim 12, wherein in a case where the control unit executes the second mode, the control unit controls voltage that is applied from the transfer power supply to the transfer member such that a first current value flowing from the transfer member to the intermediate transfer member in a first region including a rear end of the toner image that is secondarily transferred from the intermediate transfer member to the material in a conveying direction of the material is greater than a second current value flowing from the transfer member to the intermediate transfer member in a second region upstream of a distal end of the material and downstream of the first region in the conveying direction.

20. The image forming apparatus according to claim 19, wherein a width of the first region in the conveying direction is narrower than a width of the second region in the conveying direction.

21. The image forming apparatus according to claim 12, wherein the control unit controls the transfer power supply such that timing of stopping output of the voltage that is applied from the transfer power supply to the transfer member after a rear end of the toner image that is secondarily transferred from the intermediate transfer member to the transfer material passes by the transfer member when the control unit executes the second mode is delayed as compared to timing of stopping output of the voltage that is applied from the transfer power supply to the transfer member after the rear end of the toner image that is secondarily transferred from the intermediate transfer member to the transfer material passes by the transfer member when the control unit executes the first mode.

22. The image forming apparatus according to claim 12, wherein the control unit is configured to execute the second mode with the second speed ratio set to a constant value regardless of the surrounding environment.

* * * * *